US008944626B2

(12) United States Patent
Matthews et al.

(10) Patent No.: US 8,944,626 B2
(45) **Date of Patent: *Feb. 3, 2015**

(54) LIGHTING DEVICE WITH SWITCHABLE LIGHT SOURCES

(75) Inventors: John W. Matthews, Newport Beach, CA (US); Michael D. Picciotta, Yorba Linda, CA (US); William Wells, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 333 days.

This patent is subject to a terminal disclaimer.

(21) Appl. No.: 13/474,960

(22) Filed: May 18, 2012

(65) Prior Publication Data

US 2012/0268920 A1 Oct. 25, 2012

Related U.S. Application Data

(63) Continuation-in-part of application No. 12/702,146, filed on Feb. 8, 2010, now Pat. No. 8,182,109, which is a continuation-in-part of application No. 12/248,704, filed on Oct. 9, 2008, now Pat. No. 8,147,089.

(60) Provisional application No. 61/295,067, filed on Jan. 14, 2010.

(51) Int. Cl.

| | |
|---|---|
| ***F21V 33/00*** | (2006.01) |
| ***F21V 23/04*** | (2006.01) |
| ***F41G 1/35*** | (2006.01) |
| ***F41G 11/00*** | (2006.01) |
| *F21L 4/02* | (2006.01) |

(52) U.S. Cl.

CPC ..... *F21V 23/0414* (2013.01); *F41G 1/35* (2013.01); *F41G 11/003* (2013.01); *F21L 4/025* (2013.01)

USPC ..... 362/109; 362/110; 362/111; 362/112; 362/113; 362/114

(58) Field of Classification Search

CPC ..... F41G 1/35; F41G 11/003; F41G 1/34; F41G 1/00; F41G 11/001; F41G 11/004; F41G 1/36; F41G 1/383; F41G 1/40; F41G 3/00

USPC ..... 362/109–114

See application file for complete search history.

(56) References Cited

U.S. PATENT DOCUMENTS

| | | | |
|---|---|---|---|
| D96,274 | S | 4/1935 | Levy |
| D548,385 | S | 8/2007 | Sharrah et al. |
| 7,273,292 | B2 | 9/2007 | Kim |
| D567,894 | S | 4/2008 | Sterling et al. |
| D568,508 | S | 5/2008 | Howe et al. |
| D578,599 | S | 10/2008 | Cheng |

(Continued)

*Primary Examiner* — William Carter

(74) *Attorney, Agent, or Firm* — Haynes and Boone, LLP

(57) ABSTRACT

Various lighting devices and related methods are provided. In one example, a lighting device includes a main member including a central axis. The lighting device also includes a bezel surrounding at least a portion of the main member and adapted to be concentrically rotated about the central axis. The lighting device also includes a lens asymmetrically disposed in the bezel and adapted to rotate with the bezel. The lens includes a light inlet offset from the central axis. The lighting device also includes a plurality of light sources fixed relative to the main member. Rotation of the bezel relative to the main member causes the light inlet to rotate through an arc about the central axis to selectively align different ones of the light sources with the light inlet.

21 Claims, 29 Drawing Sheets

(56) References Cited

U.S. PATENT DOCUMENTS

| | | | |
|---|---|---|---|
| 7,441,918 | B2 | 10/2008 | Kim |
| D581,586 | S | 11/2008 | Conroy |
| D585,516 | S | 1/2009 | Smith |
| 7,576,515 | B2 | 8/2009 | Greenslade |
| D600,772 | S | 9/2009 | Swan |
| 7,614,760 | B2 | 11/2009 | Sharrah et al. |
| D612,970 | S | 3/2010 | Sharrah et al. |
| D616,956 | S | 6/2010 | Hamilton |
| 2004/0068913 | A1 | 4/2004 | Solinsky et al. |
| 2005/0122711 | A1 | 6/2005 | Matthews et al. |
| 2005/0122712 | A1 | 6/2005 | Kim |
| 2005/0157492 | A1 | 7/2005 | Chiu |
| 2005/0237737 | A1 | 10/2005 | Kim |
| 2007/0034890 | A1 | 2/2007 | Daschner et al. |
| 2007/0227056 | A1 | 10/2007 | Howe et al. |
| 2008/0134562 | A1 | 6/2008 | Teetzel |
| 2008/0155876 | A1 | 7/2008 | Matthews |
| 2008/0157114 | A1 | 7/2008 | Basin et al. |
| 2010/0046211 | A1 | 2/2010 | Spartano et al. |
| 2010/0091485 | A1 | 4/2010 | Matthews et al. |

LIGHTING DEVICE WITH SWITCHABLE LIGHT SOURCES

CROSS-REFERENCE TO RELATED APPLICATIONS

This application is a continuation-in-part application of U.S. patent application Ser. No. 12/702,146 entitled "LIGHTING DEVICE WITH SWITCHABLE LIGHT SOURCES" filed Feb. 8, 2010, which is a continuation-in-part application of U.S. patent application Ser. No. 12/248,704 entitled "SWITCHABLE LIGHT SOURCES" filed Oct. 9, 2008, all of which are hereby incorporated by reference in their entirety. U.S. patent application Ser. No. 12/702,146 claims the benefit of U.S. Provisional Patent Application No. 61/295,067 entitled "LIGHTING DEVICE WITH SWITCHABLE LIGHT SOURCES" filed Jan. 14, 2010, which is hereby incorporated by reference in its entirety.

BACKGROUND

1. Field of the Invention

The present invention generally relates to light producing devices and more particularly relates to light producing devices with switchable light sources.

2. Related Art

As is well known, light producing devices are typically configured to perform only a single function, namely, to illuminate areas of interest. For example, conventional lighting devices are typically implemented with mechanical and electrical structures directed to performing this single function.

Unfortunately, such conventional lighting devices have various limitations. For example, although such devices are useful for illumination with white light, there are often instances when illumination with other colors of visible light is desirable. There are also instances when illumination with infrared light, ultraviolet, light, or other wavelengths is desirable. Accordingly, there is a need for an improved lighting device that overcomes one or more of the deficiencies discussed above.

SUMMARY

A lighting device is provided which may be operated to selectively provide various types of light, such as light of different wavelengths, in response to user-actuated controls. Related methods of operation are also provided.

In one embodiment, a lighting device includes a plurality of light sources, a body, a head, and one or more controls adapted to adjust operation of the light sources. The body includes a housing. The head includes a bezel adapted to rotate relative to the body to select between at least a first one of the light sources and a second one of the light sources. The head also includes a lens adapted to rotate eccentrically relative to a centerline of the head in response to rotation of the bezel. The lens includes a light inlet adapted to be selectively positioned over the first light source, the second light source, or neither of the light sources as the lens rotates eccentrically relative to the centerline of the head.

In another embodiment, a method of operating a lighting device is provided. The lighting device includes a plurality of light sources, a head including a bezel, a lens, and a lock ring, a body including a housing, and one or more controls adapted to adjust operation of the light sources. The method includes urging the lock ring from a locked position to an unlocked position. The lock ring is adapted to prevent rotation of the bezel while the lock ring is in the locked position and permit rotation of the bezel while the lock ring is in the unlocked position. The method also includes rotating the bezel to select a first one of the light sources or a second one of the light sources. The rotating causes the lens to rotate eccentrically relative to a centerline of the head. The lens includes a light inlet adapted to be selectively positioned over the first light source, the second light source, or neither of the light sources as the lens rotates eccentrically relative to the centerline of the head. The method also includes returning the lock ring to the locked position.

In another embodiment, a lighting system includes a lighting device. The lighting device includes a plurality of light sources, a body, a head, and one or more controls adapted to adjust operation of the light sources. The body includes a housing, a connector, and a mounting surface. The head includes a bezel adapted to rotate relative to the body to select between at least a first one of the light sources and a second one of the light sources. The head also includes a lens adapted to rotate eccentrically relative to a centerline of the head in response to rotation of the bezel. The lens includes a light inlet adapted to be selectively positioned over the first light source, the second light source, or neither of the light sources as the lens rotates eccentrically relative to the centerline of the head. The lighting system also includes a remote switch. The connector is adapted to receive the remote switch to control at least one of the light sources. The lighting system also includes a rail clamp mount. The mounting surface is adapted to engage with the rail clamp mount to attach the lighting device to a weapon.

In another embodiment, a lighting device includes a plurality of light sources, a body, a head, and one or more controls adapted to adjust operation of the light sources. The body includes a housing. The head includes a bezel adapted to rotate relative to the body to select between at least a first one of the light sources and a second one of the light sources. The head also includes a reflector adapted to rotate eccentrically relative to a centerline of the head in response to rotation of the bezel. The reflector comprises a light inlet adapted to be selectively positioned over the first light source, the second light source, or neither of the light sources as the reflector rotates eccentrically relative to the centerline of the head.

In another embodiment, a lighting device comprises a generally tubular heat sink having a central axis and a generally tubular bezel disposed for concentric rotation about the heat sink. The bezel has a central axis disposed coaxially with the central axis of the heat sink and defines a common central axis therewith. A lens is disposed in the bezel for conjoint rotation therewith. The lens has a light inlet and an optical axis that is concentric with the inlet and disposed parallel to and offset from the common central axis, such that rotation of the bezel relative to the heat sink causes the light inlet and optical axis to rotate through a cylindrical arc about the common central axis. A plurality of light sources is disposed on the heat sink, behind the light inlet of the lens and at respective angular positions around the arc, such that rotation of the bezel about the common central axis and to angular positions corresponding to the respective angular positions of the light sources disposes the light inlet and optical axis of the lens in axial alignment with corresponding ones of the light sources.

In another embodiment, a lighting device includes a main member including a central axis. The lighting device also includes a bezel surrounding at least a portion of the main member and adapted to be concentrically rotated about the central axis. The lighting device also includes a lens asymmetrically disposed in the bezel and adapted to rotate with the bezel. The lens includes a light inlet offset from the central axis. The lighting device also includes a plurality of light sources fixed relative to the main member. Rotation of the bezel relative to the main member causes the light inlet to rotate through an arc about the central axis to selectively align different ones of the light sources with the light inlet.

In another embodiment, a method of operating a lighting device is provided. The lighting device includes a main member including a central axis, a bezel surrounding at least a portion of the main member, a lens asymmetrically disposed in the bezel and adapted to rotate with the bezel and comprising a light inlet offset from the central axis, and a plurality of light sources fixed relative to the main member. The method includes concentrically rotating the bezel about the central axis relative to the main member. The rotating causes the light inlet to rotate through an arc about the central axis to selectively align different ones of the light sources with the light inlet.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

In accordance with various embodiments provided herein, a lighting device may be implemented to selectively provide various types of light, such as light of different wavelengths, in response to user-actuated controls. For example, in one embodiment, such a lighting device may be a weapon-mountable lighting device providing convenient access to user controls for selectively configuring (e.g., adjusting) the operation of the lighting device. For example, such user controls may be used to adjust the switching of light sources as well as the brightness and wavelengths of light emitted by such light sources. In one embodiment, such light sources may be implemented with a plurality of light emitting diodes (LEDs) which may be selectively activated and selectively dimmed to provide light of different wavelengths. Light sources other than LEDs may be used in other embodiments.

Such a lighting device may be used in any desired combination with the various features identified in the present disclosure to provide a lighting system. In certain embodiments, such a lighting system may be particularly suited for use in tactical and combat environments (e.g., for mounting on weapons or other devices). In other embodiments, the lighting system may be used in any desired environment and for any desired application.

Figure 1A:
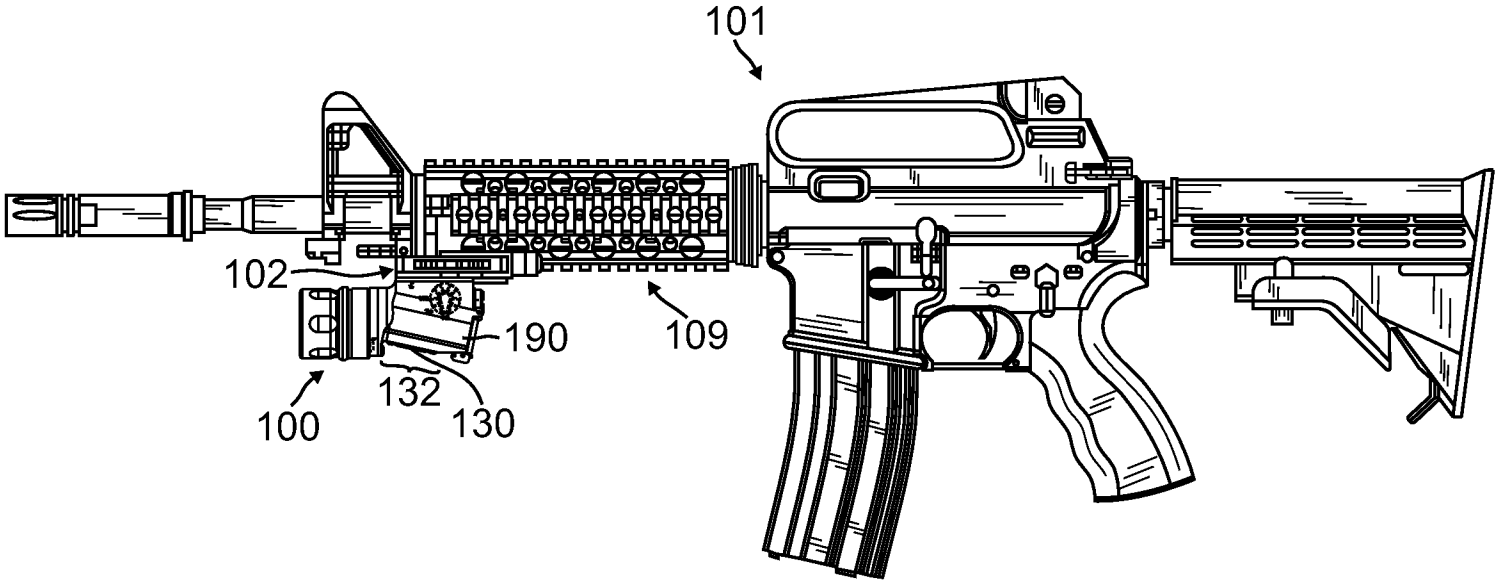
FIGS. 1A-C illustrate a lighting device attached to a weapon using various configurations in accordance with several embodiments of the invention.
Figure 1B:
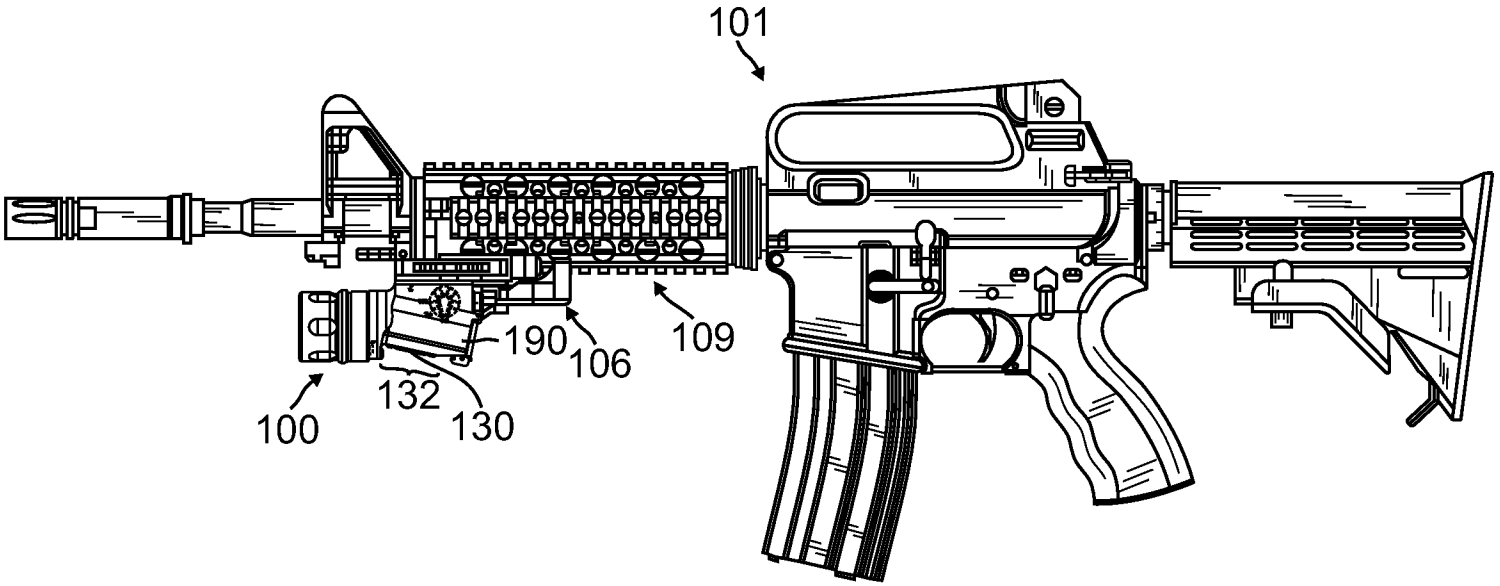
Figure 1C:
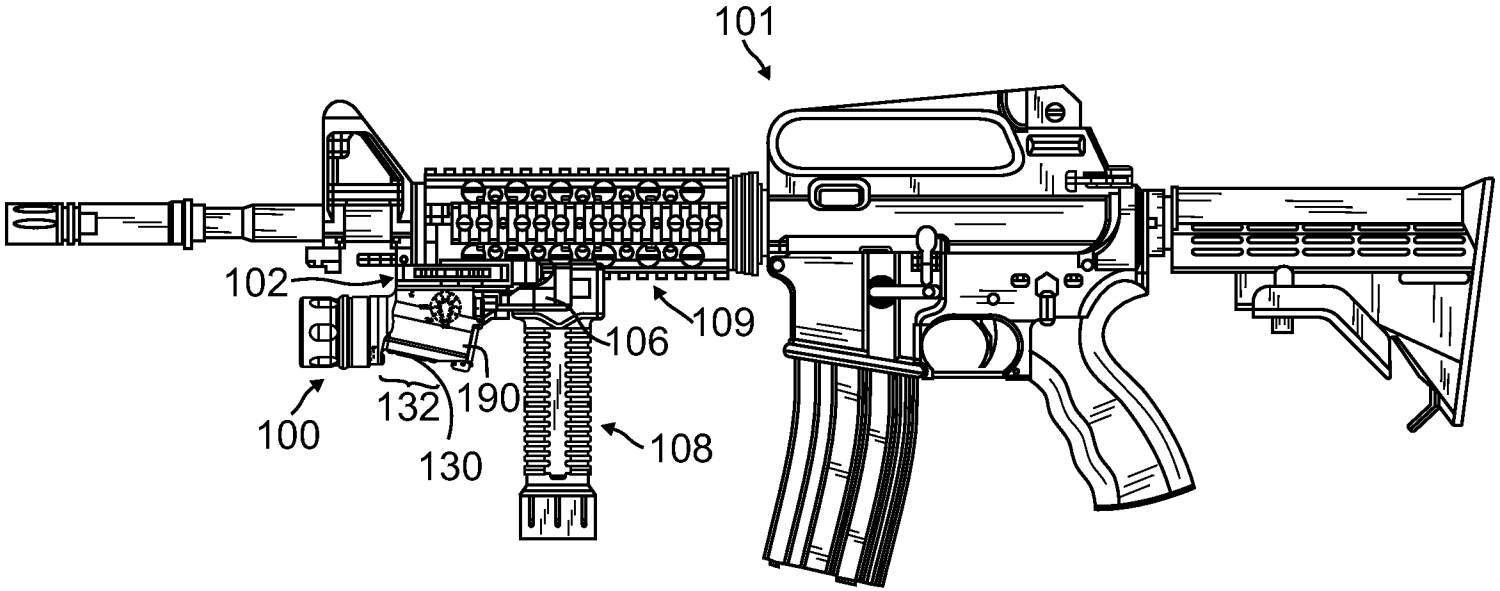

Referring now to the drawings wherein the showings are for purposes of illustrating embodiments of the present invention only, and not for purposes of limiting the same, FIGS. 1A-C illustrate a lighting device 100 attached to a weapon 101 using various configurations in accordance with several embodiments of the invention.

For example, as shown in FIG. 1A, lighting device 100 may be attached to a rail 109 of weapon 101 using a rail clamp mount 102. In one embodiment, rail clamp mount 102 may be implemented in accordance with a rail clamp mount described in U.S. patent application Ser. No. 11/646,870 entitled "RAIL CLAMP MOUNT" filed Dec. 27, 2006, which is hereby incorporated by reference herein in its entirety. In other embodiments, other rail clamp mounts may be used as appropriate.

As also shown in FIG. 1A, lighting device 100 includes an inclined external surface 132 which is inclined (e.g., angled) relative to rail 109 and a barrel of weapon 101 while lighting device 100 is attached to rail 109 by rail clamp mount 102. In one embodiment, inclined external surface 132 may be inclined relative to a centerline of a head of lighting device 100 and also inclined relative to a direction of light (e.g., light beams) provided by lighting device 100 (e.g., in FIG. 1A, lighting device 100 may provide light beams that are substantially parallel to the barrel of weapon 101). For example, in such an embodiment, inclined external surface 132 may be inclined approximately twelve degrees relative to the centerline and the direction of light. In other embodiments, other angles of inclination may be used.

Inclined external surface 132 may provide convenient access to a dome switch 130 of lighting device 100 by a user of weapon 101. In addition, the inclined external surface 132 and the external shape of a housing 190 of lighting device may permit the user to conveniently pull lighting device 100 toward the user while lighting device 100 is mounted on weapon 101 and the user is operating weapon 101.

Figure 2A:
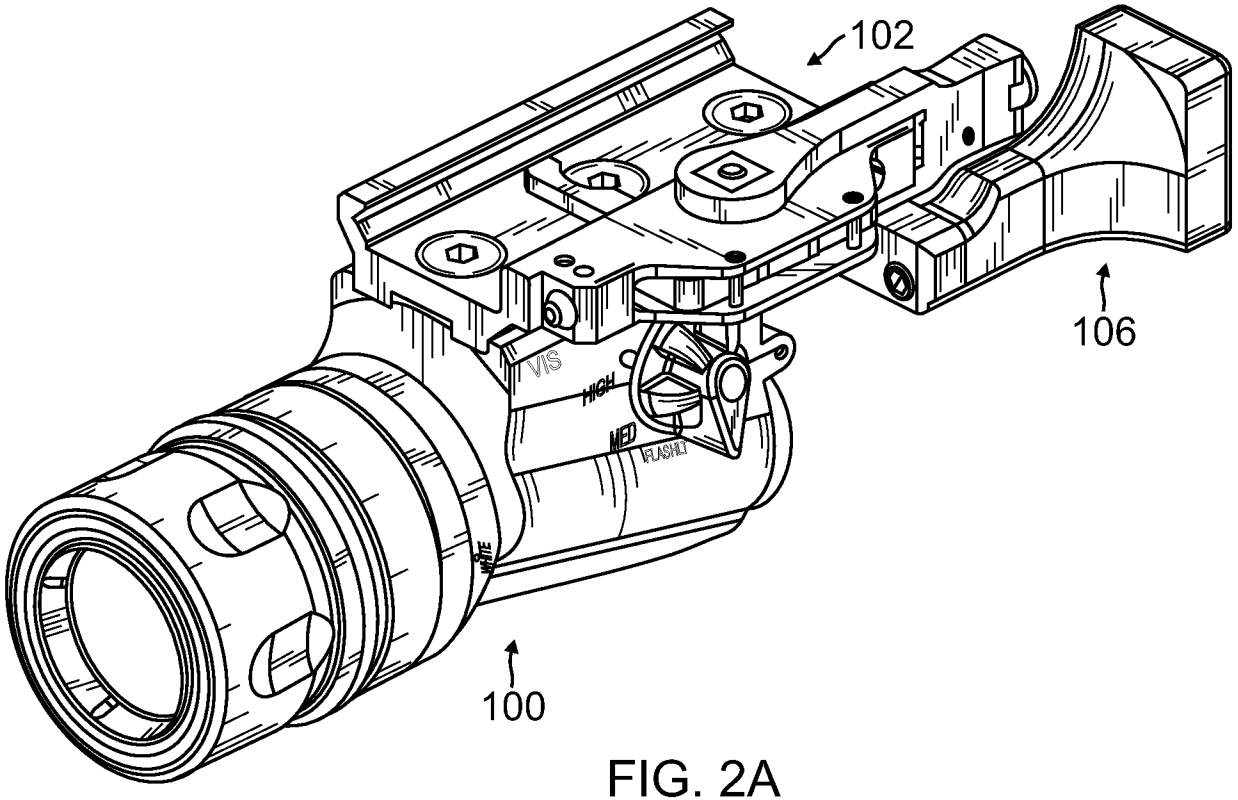
FIGS. 2A-B illustrate a lighting device connected to a switch and a rail clamp mount in accordance with several embodiments of the invention.
Figure 2B:
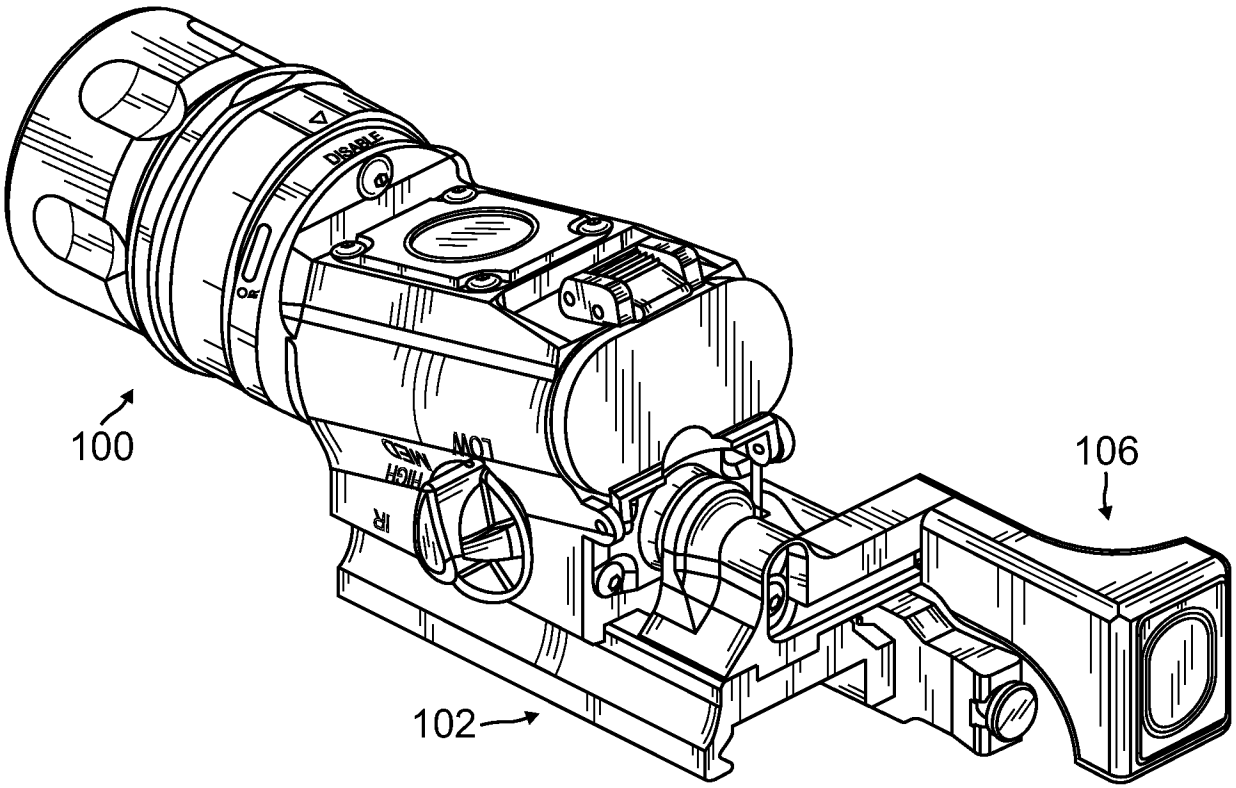
Figure 3A:
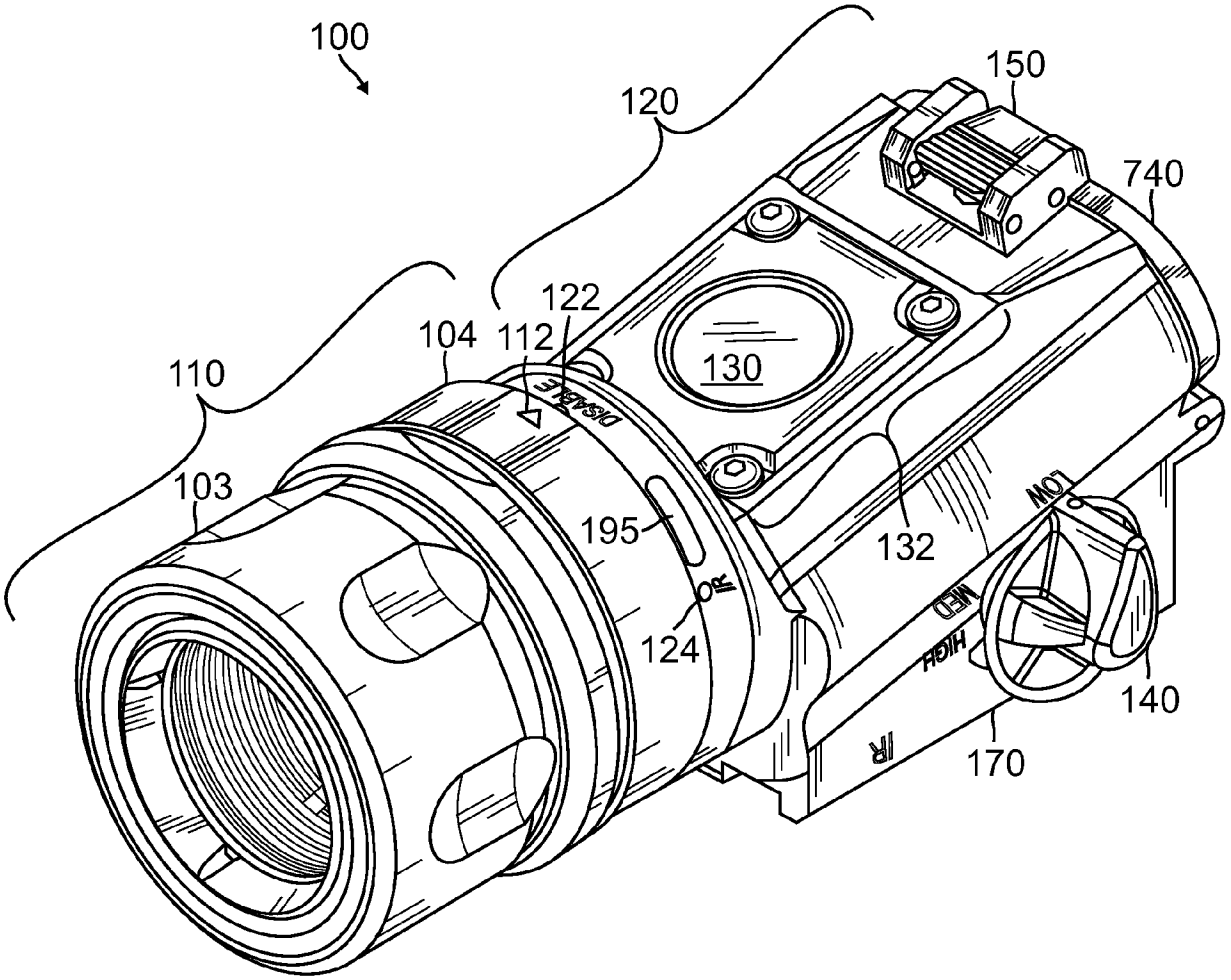
FIGS. 3A-H illustrate a lighting device in accordance with several embodiments of the invention.
Figure 3B:
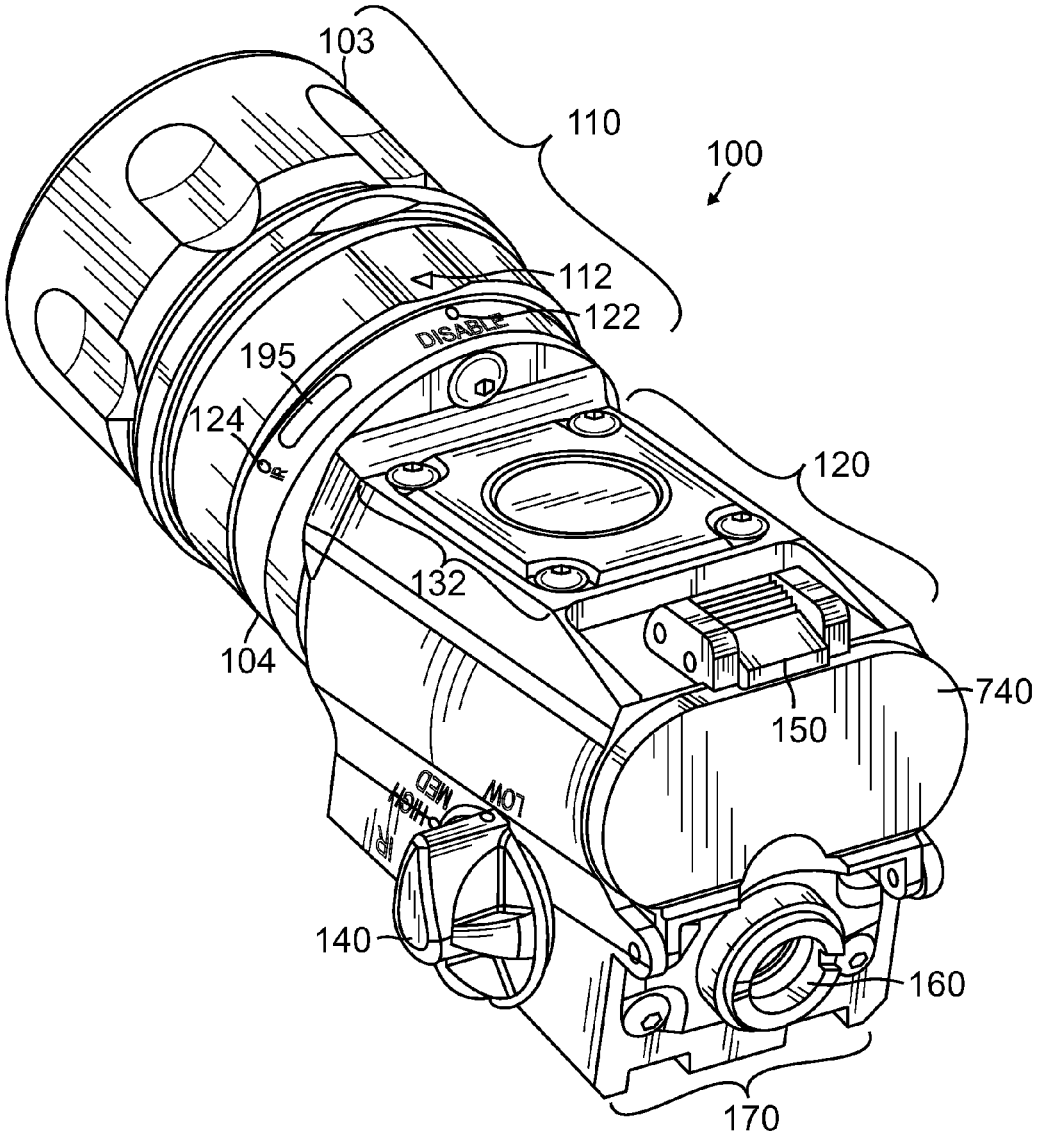
Figure 3C:
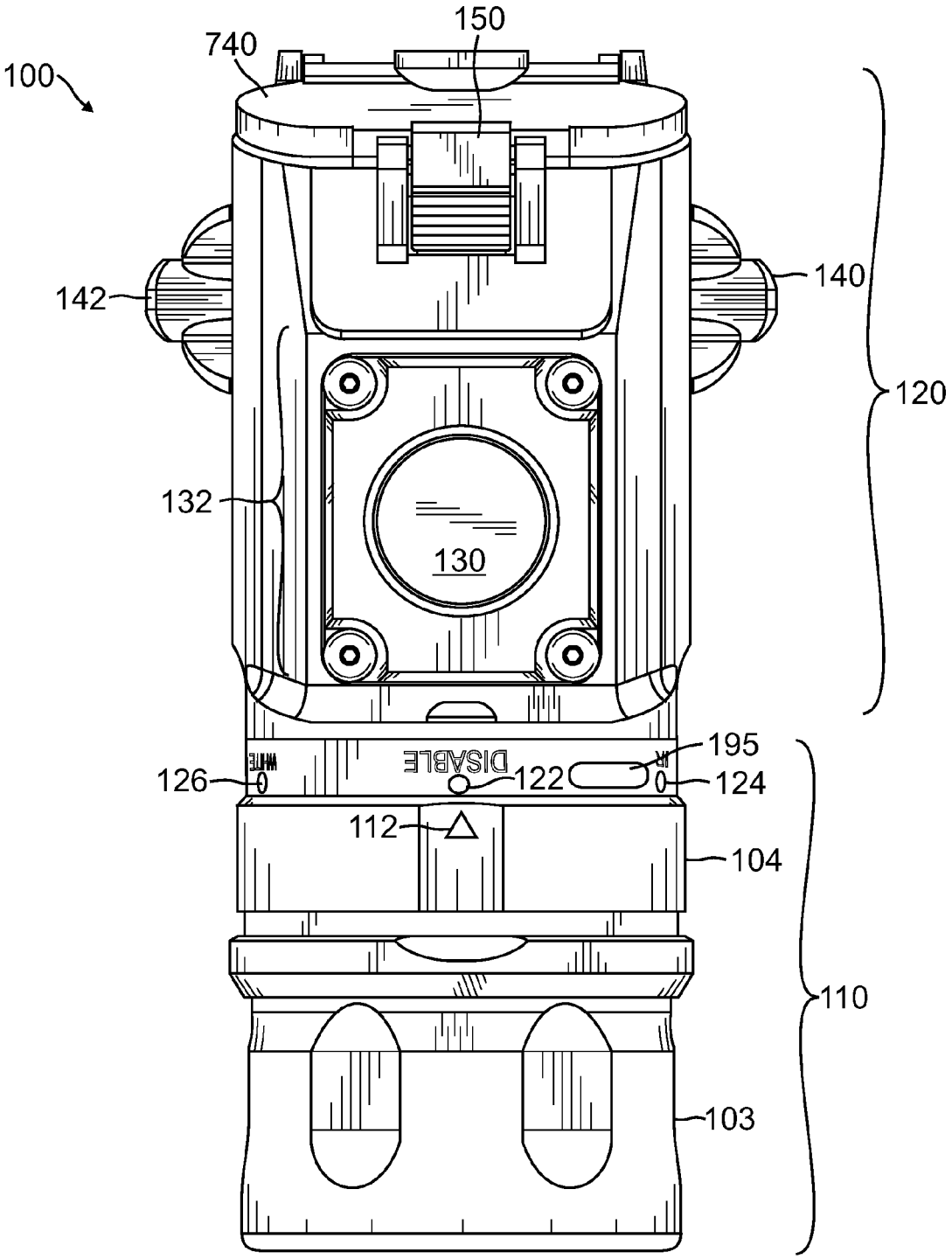
Figure 3D:
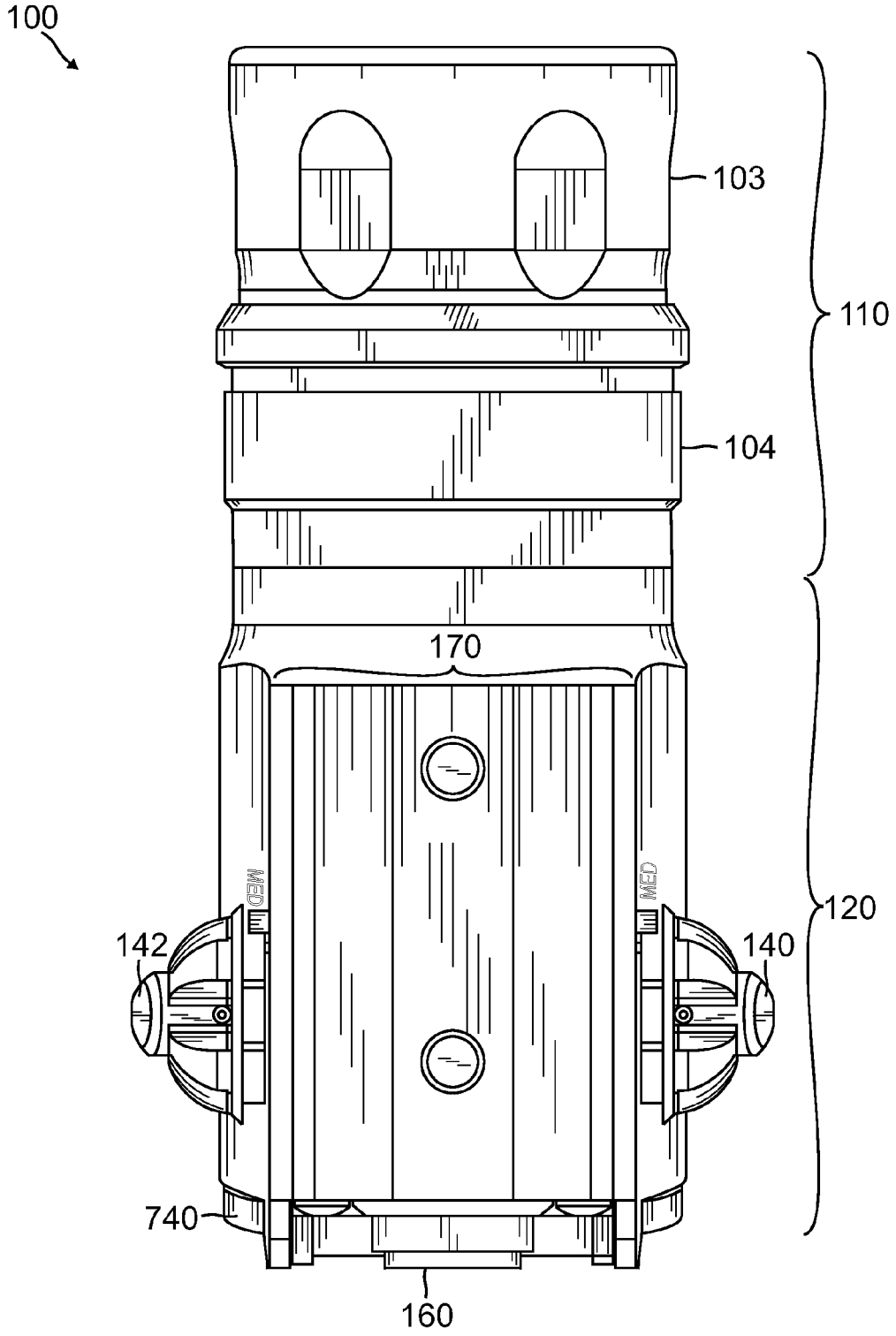
Figure 3E:
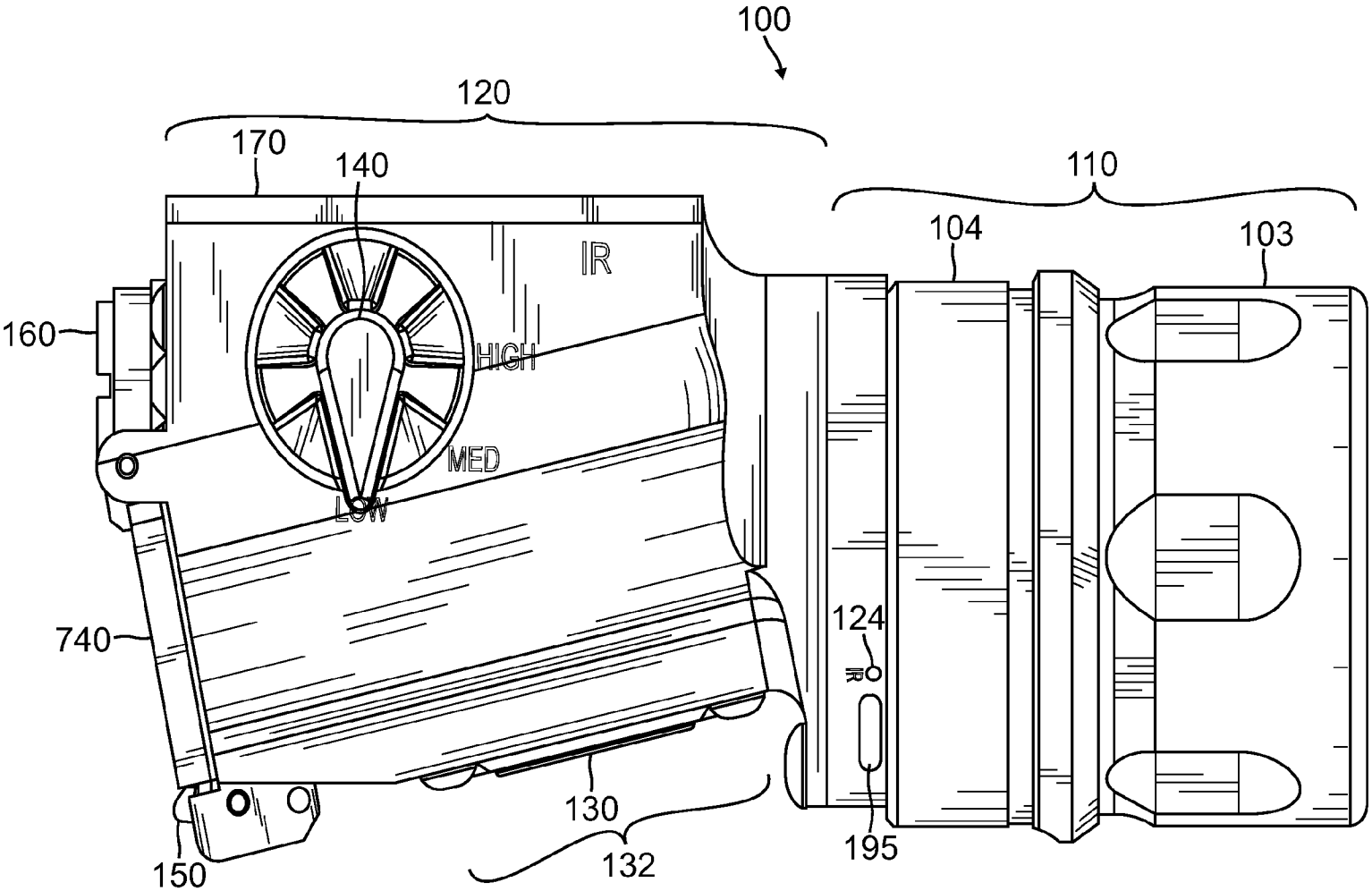
Figure 3F:
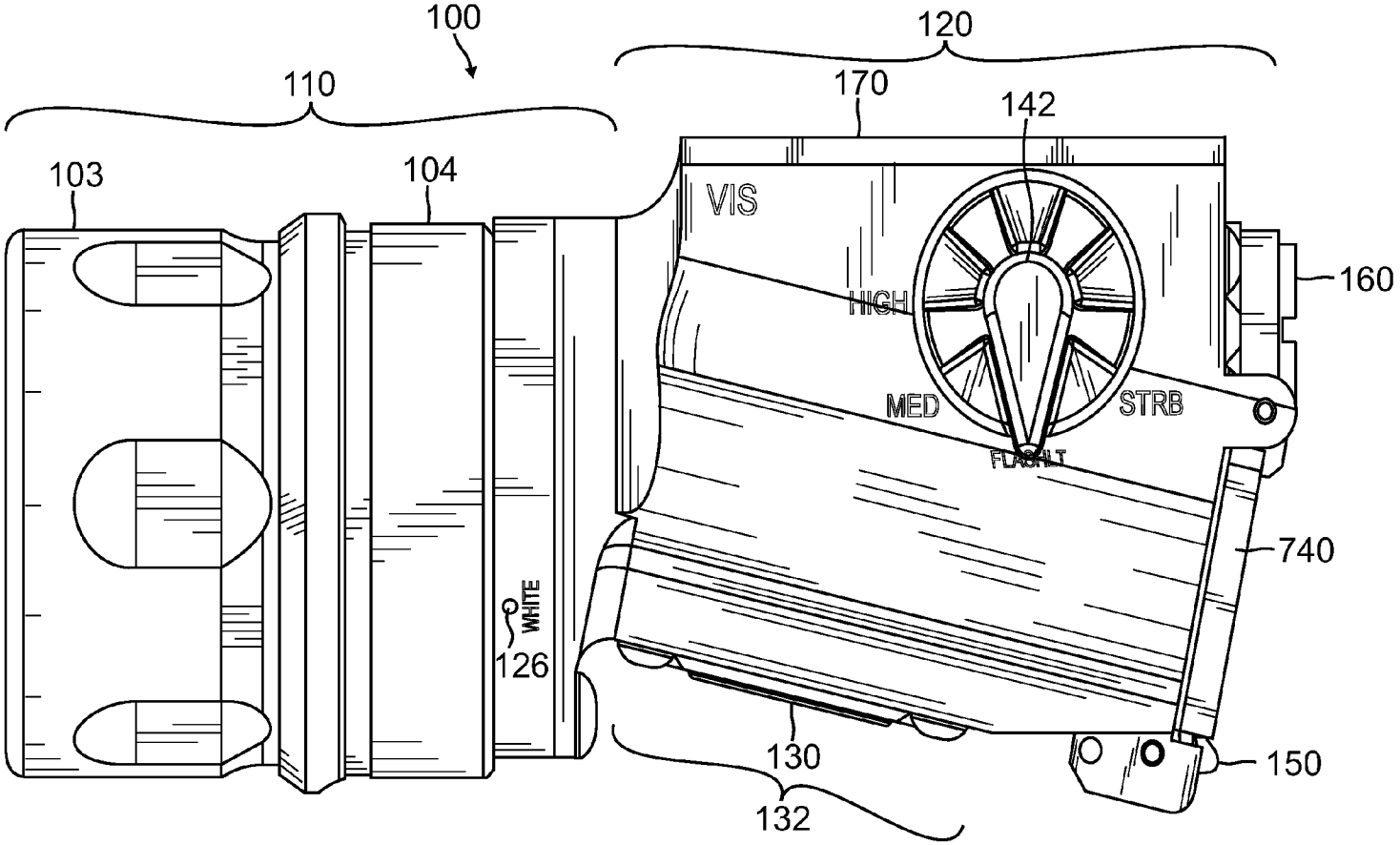
Figure 3G:
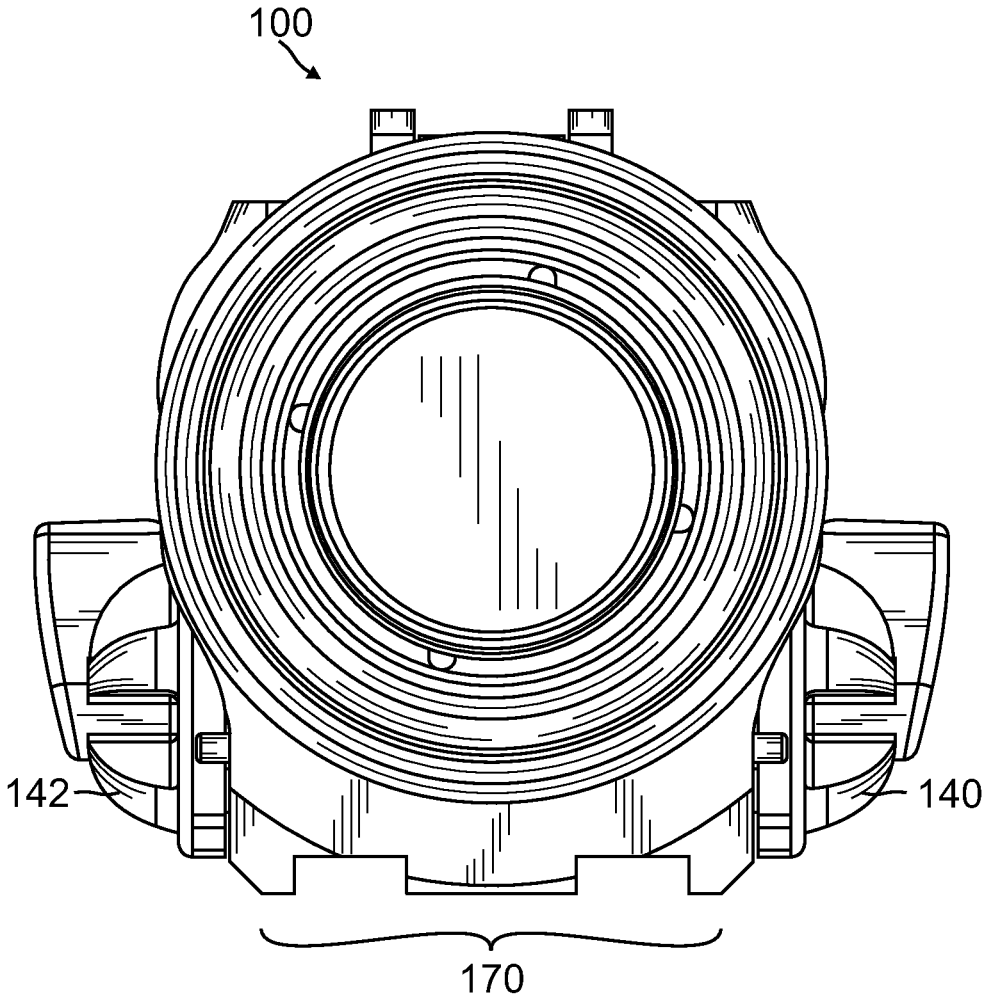
Figure 3H:
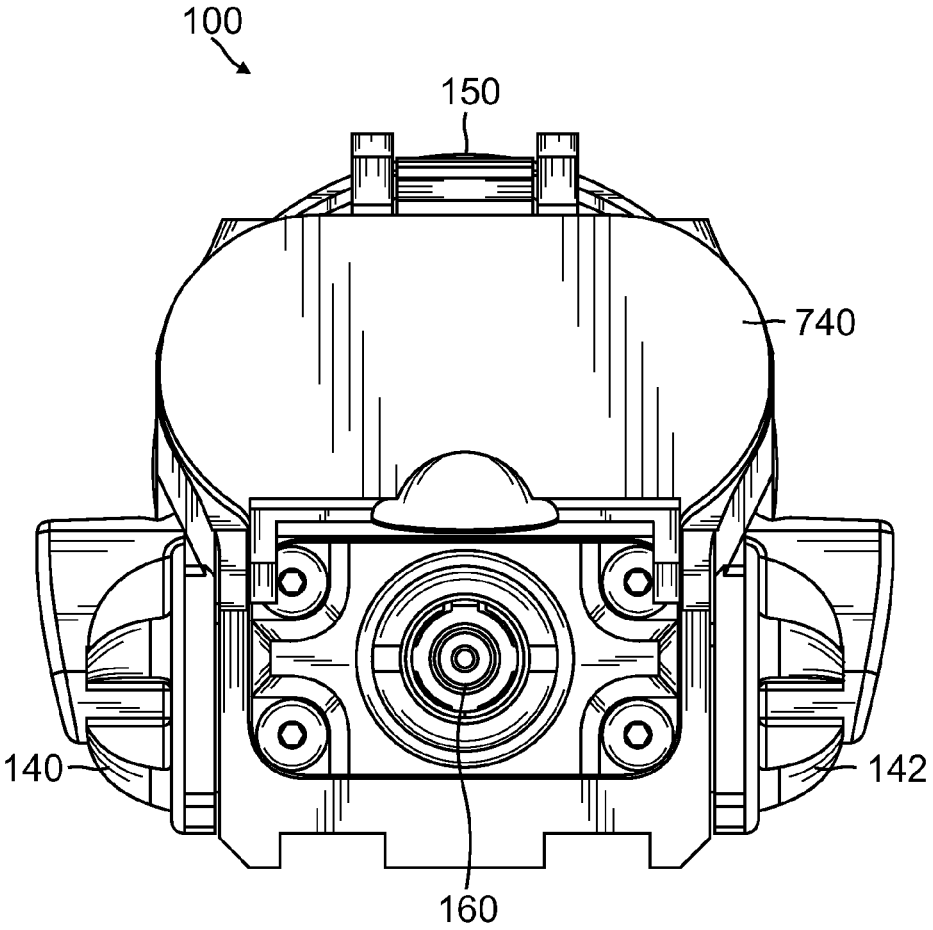

As another example, as shown in FIG. 1B, lighting device 100 may be attached to rail 109 of weapon 101 using a rail clamp mount 102 and further attached to a remote switch 106 in accordance with an embodiment of the invention. Remote switch 106 may be positioned for convenient access by a user of weapon 101 to aid the user in controlling lighting device 100 while the user also operates weapon 101. FIGS. 2A-B provide further views of lighting device 100 connected to remote switch 106 and rail clamp mount 106 in accordance with several embodiments of the invention.

As another example, as shown in FIG. 1C, lighting device 100 may be attached to rail 109 of weapon 101 using a rail clamp mount 102 and further attached to remote switch 106 as discussed above. In accordance with an embodiment of the invention, a vertical grip 108 may also be attached to rail 109 of weapon 101. In this embodiment, vertical grip 108 may provide a convenient resting location for a hand of the user of weapon 101. For example, the user may conveniently actuate remote switch 106 (e.g., by way of the user's thumb or finger) while holding vertical grip 108. In another embodiment, vertical grip 108 may include one or more switches which may be connected to lighting device 100 for controlling lighting device 100.

FIGS. 3A-H illustrate lighting device 100 in accordance with several embodiments of the invention. Lighting device 100 includes a head 110 and a body 120. Head 110 includes a bezel 103 that may rotate relative to body 120 to permit the user to select different wavelengths of light.

One or more lenses (e.g., one or more substantially flat lenses and/or one or more lenses of any other desired shape) and a plurality of light sources may be provided in head 110 to permit different wavelengths of light to be provided by lighting device 100. Although lighting device 100 is primarily described herein as having a lens, other embodiments are also contemplated. For example, in various embodiments, one or more reflectors (e.g., one or more substantially parabolic reflectors and/or one or more reflectors of any other desired shape) may be used in place of, or in addition to, one or more lenses.

Head 110 also includes a lock ring 104 (also referred to as a selector ring) that may be used to lock bezel 103 in any one of several possible positions and may also rotate with bezel 103. In one embodiment, lock ring 104 may be configured such that it locks the bezel 103 in position when lock ring 104 is positioned rearwardly (e.g., toward body 120), and such that it allows the bezel 103 to rotate when lock ring 104 is positioned forwardly (e.g., away from body 120). Thus, to select a desired position of bezel 103 (e.g., to select a desired light source), the user may urge (e.g., push, slide, or otherwise translate) lock ring 104 toward the front of head 110 (e.g., forward or away from body 120), rotate bezel 103 to the desired position, and then urge (e.g., push, slide, or otherwise translate release) lock ring 104 toward the back of head 110 (e.g., rearward or toward body 120) to lock bezel 103 in the desired position. In one embodiment, lock ring 104 may be loaded (e.g., spring loaded by springs 521-523 shown in FIG. 4) such that lock ring 104 remains biased toward body 120 when not urged by the user. As a result, the user may release lock ring 104 after bezel 103 has been rotated to the desired position (e.g., rather than requiring the user to actively urge lock ring 104 toward the back of head 110.

Lock ring 104 includes a marker 112 (e.g., an arrow or any appropriate indicia) which may be used to indicate the position of bezel 103 relative to body 120. In one embodiment, bezel 103 may be rotated to any of three possible positions such that marker 112 is located proximate a position 122, a position 124, or a position 126 of body 120. When bezel 103 is rotated such that marker 112 is located next to position 122 (labeled with an index mark "DISABLE"), light output from lighting device 100 may be disabled. When bezel 103 is rotated such that marker 112 is located next to position 124 (labeled with an index mark "IR"), lighting device 100 may provide infrared light. When bezel 103 is rotated such that marker 112 is located next to position 126 (labeled with an index mark "WHITE"), lighting device 100 may provide white light (e.g., visible white light). In other embodiments, any desired number of positions and any desired types of light (e.g., ultraviolet light or other types) may be provided.

As shown in FIGS. 3A-H, lighting device 100 includes various additional controls. For example, a dome switch 130 may be provided on inclined external surface 132 to control lighting device 100. In several embodiments, dome switch 130 may be used to switch lighting device 100 on and off in accordance with various modes of operation. For example, dome switch 130 may operate with other circuitry (e.g., see FIG. 7) to select a momentary on mode (e.g., in which lighting device 100 provides light while dome switch 130 is held in an on position by the user), a constant on mode (e.g., in which lighting device 100 continues to provide light after dome switch 130 has been twice depressed and released in quick succession by the user), and a flashlight mode (e.g., in which lighting device 100 may be used as a flashlight such as when lighting device 100 is detached from weapon 101).

Lighting device 100 also includes a rotary switch 140 which may be used to select various levels of light output (e.g., low, medium, and high as indicated by the labels "LOW," "MED," and "HIGH") provided by an infrared light source of lighting device 100 (e.g., when head 110 is rotated such that marker 112 of lock ring 104 is proximate position 124).

Lighting device 100 also includes a rotary switch 142 which may be used to select various levels of light output (e.g., flashlight brightness, medium, and high as indicated by the labels "FLASHLT," "MED," and "HIGH") provided by a visible light source of lighting device 100 (e.g., when head 110 is rotated such that marker 112 of lock ring 104 is proximate position 126). Rotary switch 142 may also be used to select a strobe mode of operation (e.g., as indicated by the label "STRB") in which the visible light source of lighting device 100 pulses on and off in a strobe-like fashion.

In one embodiment, rotary switches 140 and 142 may be provided on substantially opposite sides of housing 190. Such an implementation may provide the user with convenient access to both of rotary switches 140 and 142 when operating weapon 101.

Lighting device 100 also includes a latch 150 which may be used to secure a tail cap 740. Lighting device 100 also includes mounting surfaces 170 which may engage with rail clamp mount 102 to connect lighting device 100 to remote switch 106 the manner shown in FIGS. 2A-B.

Lighting device 100 also includes a connector 160 configured to receive remote switch 106 to connect remote switch 106 or other switches (e.g., a switch provided by vertical grip 108 or otherwise) to lighting device 100 in the manner shown in FIGS. 2A-B. In several embodiments, connector 160 may be implemented to be compatible with switches described in U.S. Pat. Nos. 7,273,292 and 7,441,918 which are both hereby incorporated by reference herein in their entirety. In other embodiments, other connectors may be used as appropriate.

Lighting device 100 may also include an indicator button 195 (e.g., a physical tactile surface). In one embodiment, indicator button 195 may be an infrared indicator button which provides tactile feedback to the user to indicate that lighting device 100 has been configured to provide infrared light without requiring the user to visually check the position of lock ring 104 or activate lighting device 100. In other embodiments, indicator button 195 may be used to indicate any desired configuration of lighting device 100.

Figure 4:
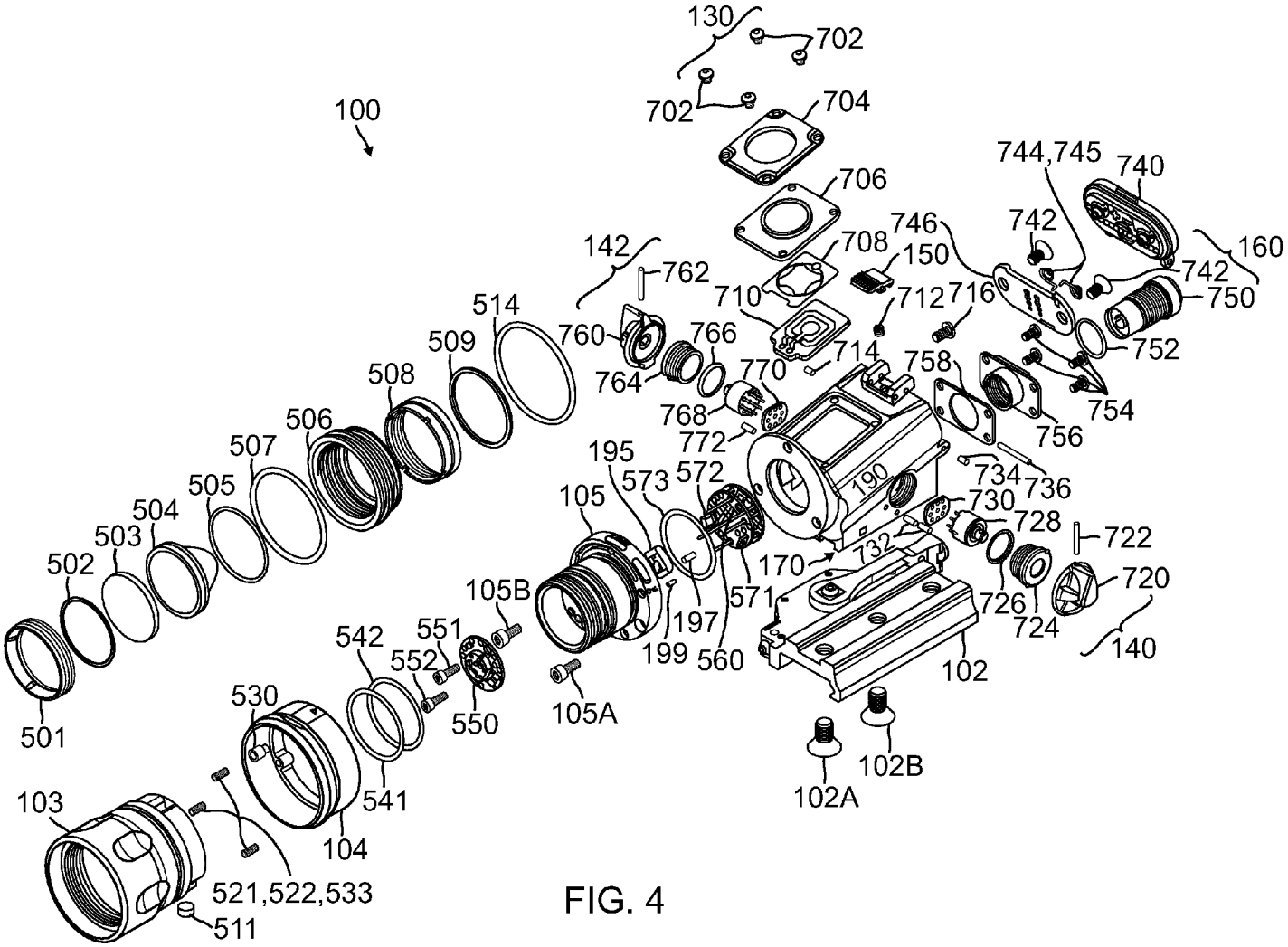
FIG. 4 illustrates an exploded view of a lighting device in accordance with an embodiment of the invention.

FIG. 4 illustrates an exploded view of lighting device 100 in accordance with an embodiment of the invention. FIG. 4 further illustrates rail clamp mount 102 which may be secured to mounting surfaces 170 by screws 102A and 102B.

As shown in FIG. 4, a lens retainer 501 may secure a planar lens 503 and a total internal reflection (TIR) lens 504 into a TIR housing 506. A flat gasket 502 may be disposed between lens retainer 501 and planar lens 503. An o-ring 505 may be disposed between the TIR lens 504 and the TIR housing 506. Lens retainer 501 may be threaded into TIR housing 506 so as to capture flat gasket 502, planar lens 503, TIR lens 504, and o-ring 505 between lens retainer 501 and TIR housing 506.

In one embodiment, planar lens 503 may be a substantially a flat (e.g., plano-plano) lens. It is contemplated that planar lens 503 may be implemented in accordance with any desired type of lens in other embodiments. In one embodiment, TIR lens 504 may be implemented as a solid optical element that uses total internal reflection to direct light from a selected light source (e.g., an LED or other light source) to planar lens 503. Planar lens 503 and TIR lens 504 may be formed of glass, plastic, or any other desired material that is substantially transparent at the wavelengths of light produced by the light sources. Indeed, any desired combination of material and types of lenses may be used.

TIR housing 506 may thread into the bezel 103. An o-ring 507 may be captured between TIR housing 506 and bezel 103. Bezel 103 may include a magnet 511 that is disposed within an opening 512 (see FIG. 5A) of bezel 103.

In an embodiment implemented with two light sources, bezel 103 may be used to select one light source at one extreme of its rotation and may be used to select another light source at the other extreme of its rotation. In one embodiment, bezel 103 may be rotated a maximum of approximately 135 degrees.

A bezel retainer 508 may thread onto heat sink 105 so as to capture and retain bezel 103 upon heat sink 105. A flat gasket 509 may be disposed between bezel retainer 508 and heat sink 105. Bezel 103 may have a bore (such as bore 651 of FIG. 5A) that is off center or eccentric with respect to a centerline 600 of head 110 (see FIG. 5A). Thus, rotation of bezel 103 may result in off center or eccentric rotation of bezel 103, as well as of components attached to bezel 103, such as TIR lens 504.

An o-ring 514 may be captured between bezel 103 and lock ring 104. A plurality of springs (e.g., three springs 521-523) may bear upon lock ring 104 and bezel 103 in a manner that tends to urge lock ring 104 away from the bezel 103 (e.g., rearwardly) and that thus tends to maintain lock ring 104 in the locked position thereof. That is, springs 521-523 may bias lock ring 104 toward body 120.

Spring 521-523 may be received within a detent 530. Detent 530 may be received within one of a plurality of holes, such as a hole 531 (see FIG. 5A), to lock bezel 103 into position with respect to heat sink 105. In one embodiment, the number of such holes may conform to the number of positions in which it is desired for bezel 103 to lock into position. In one embodiment, the number of such positions of bezel 103 may conform to the number of different light sources of lighting device 100 that may be selected by the user. In one embodiment, one of the holes, such as hole 531, may be used to lock bezel 103 into a position in which marker 112 is proximate position 124 for selecting an infrared light source, and another one of the holes may be used to lock bezel 103 into a position in which marker 112 is proximate position 126 for selecting a white light source. The holes may be spaced apart by any desired distance. Thus, the distance or angle through which bezel 103 is rotated to select different light sources may be any desired distance or angle.

Lock ring 104 may slide over and be slidably disposed upon bezel 103. In turn, bezel 103 may slide over and be rotatably disposed upon heat sink 105. Two o-rings 541 and 542 may be disposed upon heat sink 105, between bezel 103 and heat sink 105. O-rings 541 and 542 may provide a bearing surface that facilitates rotation of bezel 103 with respect to heat sink 105.

Heat sink 105 may receive and mount a light source printed circuit board (PCB) 550. Light source PCB 550 may be attached to heat sink 105 via screws 551 and 552. PCB 550 may include one or more light sources (e.g., LEDs and/or other types of light sources) attached thereto. In one embodiment, such LEDs may be implemented using one or more dies (e.g., multiple die LEDs). In one embodiment, one or more white light LEDs and one or more infrared LEDs may be attached to light source PCB 550. Heat sink 105 may operate as a heat sink for light sources that are attached to light source PCB 550. Thus, heat sink 105 may dissipate heat from the light sources to other parts of lighting device 100 and to ambient air. As also shown in FIG. 4, an o-ring 573 may be disposed between heat sink 105 and housing 190. Heat sink 105 may also include indicator button 195, a pin 197, and a spring 199 further described herein.

A control PCB 560 may be received within heat sink 105, such as within the end thereof that attaches to housing 190 by screws 105A, 105B, and 716. In one embodiment, control PCB 560 may be implemented using two stacked PCBs as shown in FIG. 4. Light source PCB 550 and/or control PCB 560 may be electrically connected to one or more batteries provided within a cavity 151 (see FIG. 5A) of housing 190.

Control PCB 560 may include circuitry to determine which, if any, of the light sources are to be illuminated, and also to illuminate the selected light source. Thus, control PCB 560 may receive electric power from one or more batteries and provide electric power to the selected light source. In one embodiment, heat sink 105 may make electrical contact with housing 190 which may be electrically connected to a terminal of one or more batteries to provide an electrical connection. One or more additional electrical connections may be implemented using appropriate springs, wires, or other techniques which will be appreciated by those skilled in the art.

More particularly, one or more Hall effect sensors may be attached to control PCB 560 to sense the current position of bezel 103. For example, two Hall effect sensors 571 and 572 may be attached to control PCB 560 to sense the position of magnet 511 that is attached to the bezel 103. In this manner, the position to which bezel 103 has been rotated may be sensed to determine which light source is to be illuminated by control PCB 560.

As shown in FIG. 4, dome switch 130 may be assembled using screws 702, a switch plate 704, a button pad 706, a switch 708, and a switch PCB 710.

As also shown in FIG. 4, rotary switches 140/142 may be assembled using knobs 720/760, dowel pins 722/762, caps 724/764, gaskets 726/766, switches 728/768 (e.g., switches permitting approximately 135 degree rotation in one embodiment), switch PCBs 730/770, and pins 732/772.

As also shown in FIG. 4, connector 160 may be assembled using a receptacle 750, an o-ring 752, screws 754, a connector plate 756, and a gasket 758. Connector 160 may interface with control PCB through appropriate electrical connections as will be appreciated by those skilled in the art.

Lighting device 100 may further include latch 150, a spring 712 (e.g., for spring loading latch 150), a pin 714, pins 734/736, tail cap 740, and screws 742. In addition, lighting device 100 may further include battery contact springs 744/745 and battery contact PCB 746, all of which may be used to provide appropriate electrical connections between one or more batteries, light source PCB 550, and/or control PCB 572.

In one embodiment, the structural components of lighting device 100 may be formed of a metal, such as aluminum, magnesium, or steel. In another embodiment, these structural components may be formed of a durable plastic, such a polycarbonate or acrylonitrile butadiene styrene (ABS), or any other material as desired. In another embodiment, the structural components proximate magnet 511 (e.g., bezel 103 and heat sink 105) may be formed of a non-ferrous material such that sensing of magnet 511 by Hall effect sensors 571 and 572 is not substantially inhibited thereby.

Figure 5A:
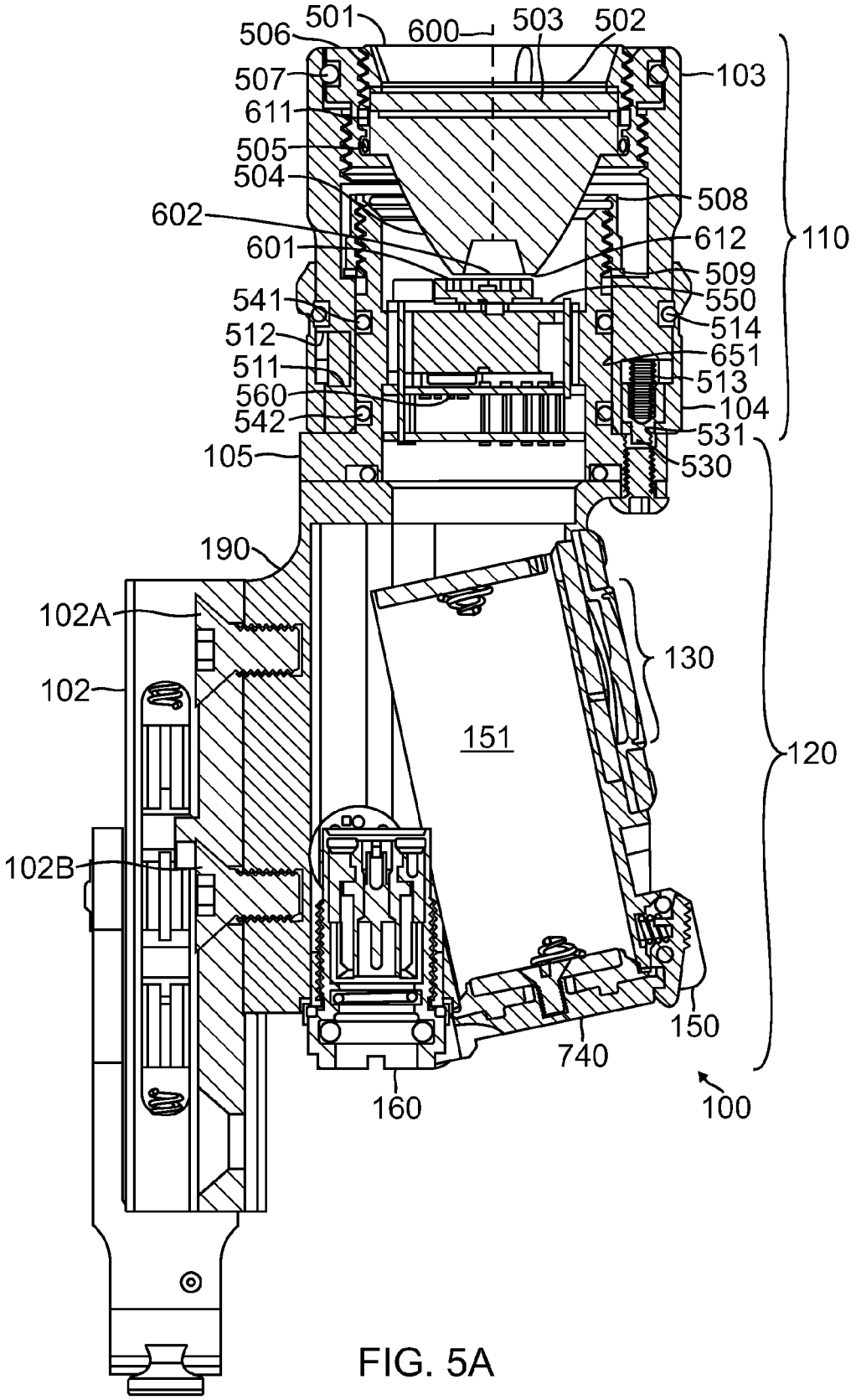
FIG. 5A illustrates a cross-sectional side view of a lighting device attached to a rail clamp mount in accordance with an embodiment of the invention.

FIG. 5A illustrates a cross-sectional side view of lighting device 100 attached to rail clamp mount 102 in accordance with an embodiment of the invention. As shown in FIG. 5A, a light source assembly 601 may include a plurality of light sources that are attached to light source PCB 550. Light source assembly 601 may include one or more white light sources, one or more infrared light sources LEDs, one or more ultraviolet light sources, and/or other types of light sources. In one embodiment, light source assembly 601 may include a plurality of white light LEDs that are grouped together, and may further include a plurality of infrared light LEDs that are grouped together.

In one embodiment, light source assembly 601 may be configured such that none of the light sources are on centerline 600 of head 110. Thus, a white light source and an infrared light source may both be off center with respect to centerline 600. In one embodiment, the white light source and the infrared light source may both be off center with respect to centerline 600 by the same amount and may both be disposed upon an arc defined by movement of a bottom end 612 of TIR lens 504, as discussed in detail below.

Light source assembly 601 may similarly include other light sources or groups of light sources. For example, in one embodiment, light source assembly 601 may include a group of red light sources, a group of green light sources, and/or a group of blue light sources. Light source assembly 601 may include any desired number of groups of light sources and each group of light sources may include any desired number and/or combination of light sources. Accordingly, discussion herein of white light sources and infrared light sources is by way of example only, and not by way of limitation.

TIR lens 504 may be generally conical in configuration. TIR lens 504 may have a top end 611 (e.g., a larger end) that is proximate planar lens 503 and may have a bottom end 612 (e.g., a smaller end) that is proximate light source assembly 601. Top end 611 and bottom end 612 of TIR lens 504 may be eccentric with respect centerline 600 of head 110. Thus, rotation of head 110 may cause TIR lens 504, and in particular bottom end 612 of TIR lens 504, to move in an arc. The light sources of light source assembly 601 may be disposed along this arc such that rotation of TIR lens 504 moves bottom end 612 thereof from one light source to another light source.

TIR lens 504, and more particularly bottom end 612 thereof, may be made to be eccentric or offset with respect to centerline 600 of head 110 by forming a bore 651 of bezel 103 to be eccentric with respect to centerline 600 of head 110. Thus, as bezel 103 is rotated with respect to light source assembly 601, TIR lens 504 moves in an arc, as described above.

Bottom end 612 may include a light inlet 602 that is configured to receive light from light source assembly 601 into TIR lens 504. Bottom end 612, and more particularly light inlet 602, may move from one light source to another light source as bezel 103 is rotated.

Thus, rotation of TIR lens 504 may be caused by rotation of bezel 103 to which TIR lens 504 is attached. Such movement may move inlet 602 from being positioned proximate one light source of light source assembly 601 to being positioned proximate another light source of LED assembly 601. Thus, rotation of bezel 103 may be used to select which light source of light source assembly 601 provides light to TIR lens 504. For example, when light inlet 602 is positioned proximate a white light source that is turned on, then white light from the white light source enters TIR lens 504 and lighting device 100 provides white light. Similarly, when the light inlet 602 is positioned proximate an infrared light source that is turned on, then infrared light from the infrared light source enters TIR lens 504 and lighting device 100 provides infrared light. Thus, TIR lens 504 is movable between light sources and the position of inlet 602 determines from which light source TIR lens 504 receives light.

Embodiments may be configured to facilitate locking of bezel 103 in a desired position. For example, bezel 103 may be locked in a position for the desired light, (e.g., white or infrared) to be provided by lighting device 100. Lock ring 104 may be configured such that when lock ring 104 is positioned toward the bottom of head 110, then bezel 103 is locked in position and rotation thereof is inhibited. Conversely, lock ring 104 may be configured such that when lock ring 104 is positioned toward the top of head 110, then bezel 103 is not locked in position, such that rotation thereof is facilitated. Springs 521-523 may bias lock ring 104 in position toward the bottom of head 110 such that bezel 103 is locked unless the user moves the lock ring 104 toward the top of the head 110.

Lock ring 104 may interface with bezel 103 such that bezel 103 may only rotate if lock ring 104 may rotate. For example, lock ring 104 may interface with bezel 103 via a plurality of splines. When lock ring 104 is moved toward the top of head 110, then detent 530 may be pulled by lock ring 104 from opening 531 of heat sink 105 within which detent 530 is seated. When detent 530 is seated within opening 531, bezel 103 is locked in position and rotation is inhibited. When detent 530 is pulled from opening 531, bezel 103 is not locked in position and rotation is facilitated.

In certain embodiments, lighting device 110 may be configured so as to provide electric power only to selected light sources. For example, electric power may be provided only to the light source that provides light to TIR lens 504. Rotation of bezel 103 may determine which light source is provided electric power.

Figure 5B:
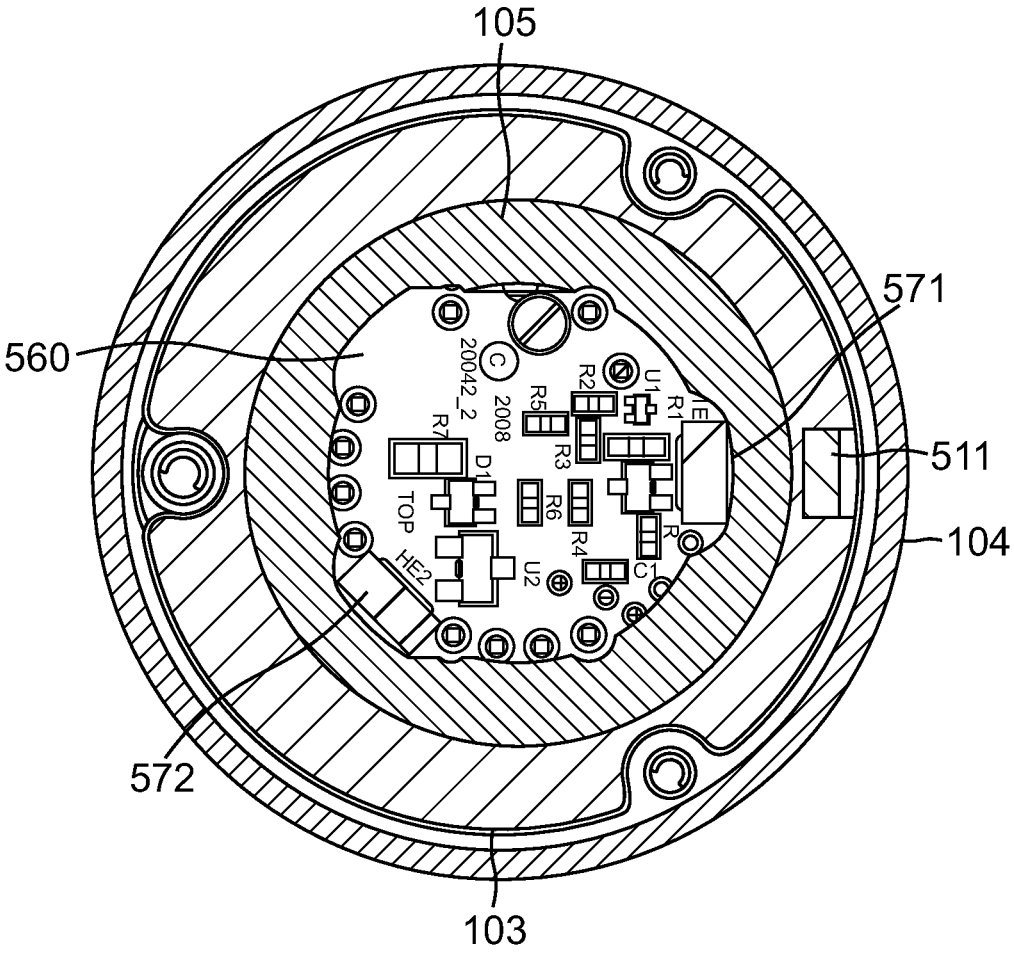
FIG. 5B illustrates a cross-sectional front view of a head of a lighting device in accordance with an embodiment of the invention.

FIG. 5B illustrates a cross-sectional top view of head 110 of lighting device 100 in accordance with an embodiment of the invention. As shown in FIG. 5B, one or more Hall effect sensors may cooperate with one or more magnets to sense rotation of bezel 103 and thus to facilitate selection of the desired light source that is to be provided electrical power and thus illuminated. For example, Hall effect sensors 571 and 572 (which are attached to control PCB 560) may be fixed with respect to heat sink 105. Magnet 511 (which is attached to bezel 103) rotates with bezel 103. Thus, rotation of bezel 103 may move magnet 511 from proximate one Hall effect sensor 571 or 572 to proximate the other Hall effect sensor 572 or 571. Each Hall effect sensor 571 and 572 may sense the presence of magnet 511, thus facilitating the use of rotation of bezel 103 to select which light source receives electric power.

In various embodiments, any desired combination of control of electrical power and alignment of TIR lens 504 with a light source may be provided by rotation of bezel 103. Thus, for example, rotation of bezel 103 may both align TIR lens 504 with the light source that provides the desired output (e.g., white light or infrared light), and may facilitate the application of electric power to the same light source.

Figure 6B:
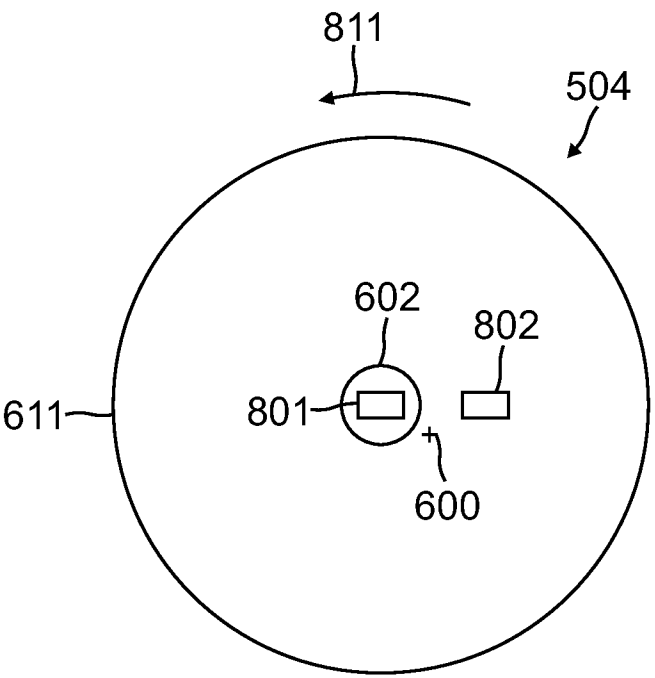
FIGS. 6A-B illustrate relative positions of a light inlet and light sources when a bezel of a lighting device is rotated in different positions in accordance with several embodiments of the invention.
Figure 6A:
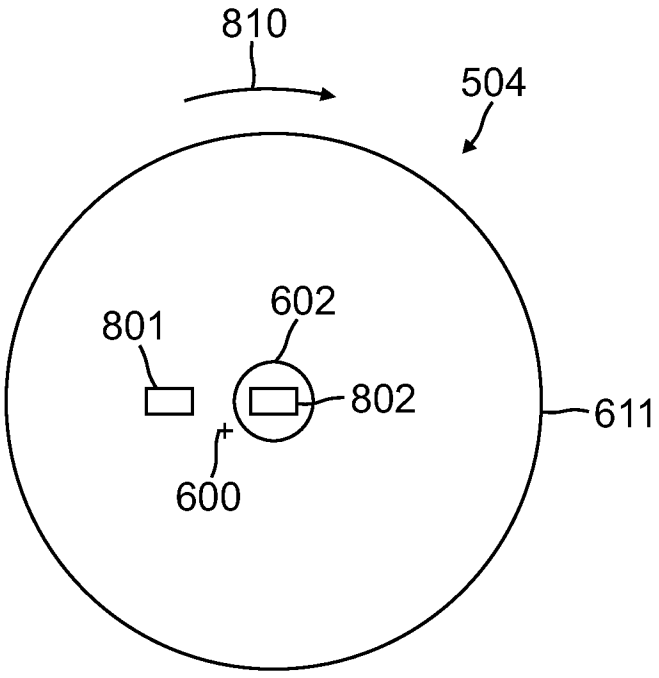

FIGS. 6A-B illustrate relative positions of light inlet 602 and light sources 801 and 802 when bezel 103 is rotated in different positions in accordance with several embodiments of the invention. In particular, FIGS. 6A-B are top views that show schematically how rotation of TIR lens 504 (such as rotation caused by rotation of bezel 103) facilitates the selection of one of two different light sources 801 and 802. In FIGS. 6A-B, light source 801 is a white light LED and light source 802 is an infrared LED.

The eccentricity of TIR lens 504 has been exaggerated in FIGS. 6A-B, so as to more clearly show how such eccentricity facilitates the selection of the desired light source. As discussed herein, any desired number of such light sources may be selected from in this manner. For example, two, three, four, or more LEDs may be selected from in this manner FIG. 6A shows TIR lens 504 after being rotated in the direction of an arrow 810 such that light inlet 602 thereof is proximate (e.g., above) infrared LED 802. FIG. 6B shows TIR lens 504 after being rotated in the direction of an arrow 811 which results in movement of light inlet 602 from the infrared LED 802 to the white light LED 801.

TIR lens 504 is offset or eccentric with respect to centerline 600 of head 110 such that the position of TIR lens 504 changes substantially between FIGS. 6A and 6B. More particularly, bottom end 612 and light inlet 602 of TIR lens 504 change positions substantially between FIGS. 6A and 6B. This change in position occurs because TIR lens 504 is substantially eccentric with respect to centerline 600 and rotates about centerline 600.

Figure 7:
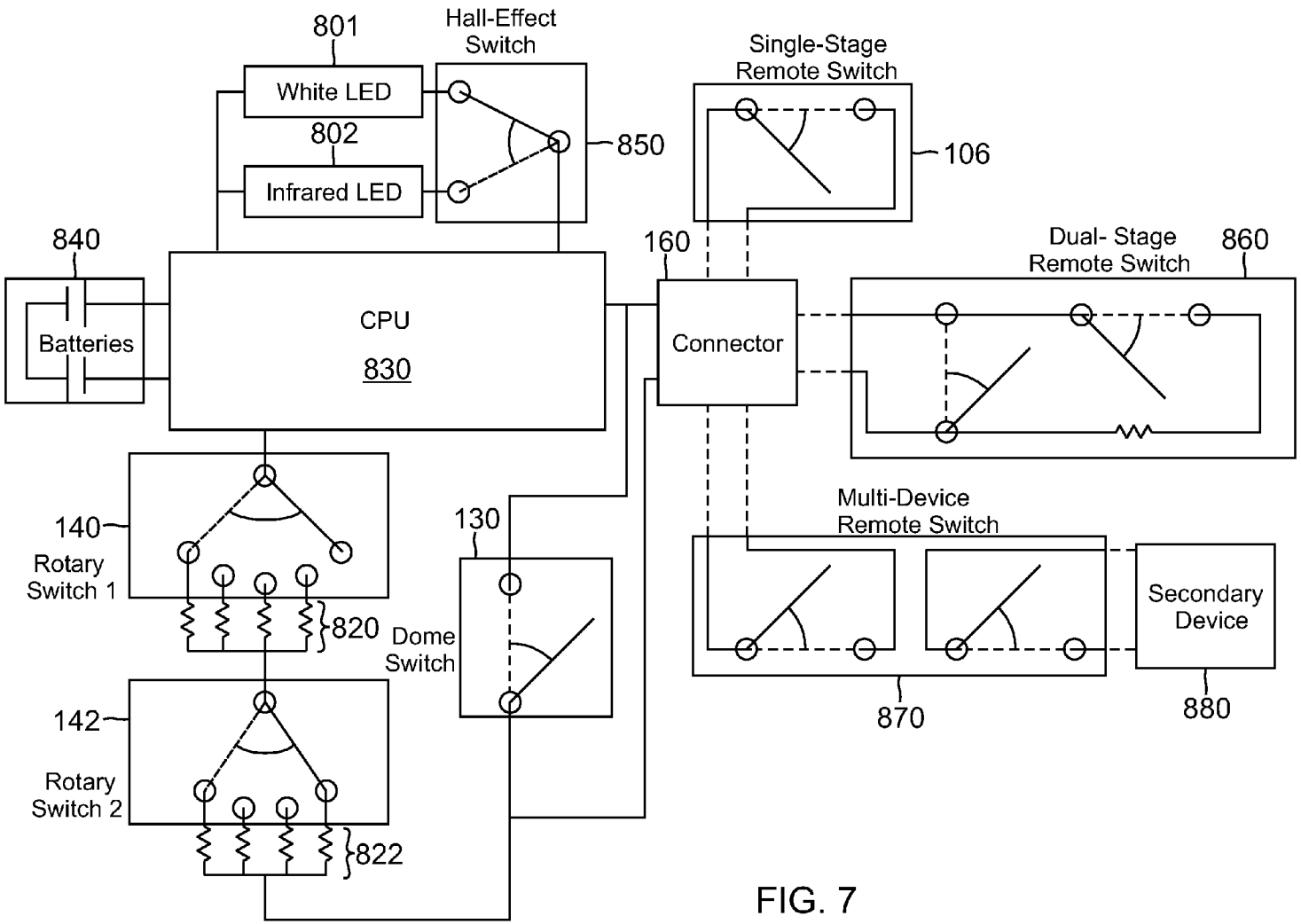
FIG. 7 illustrates an electrical schematic of a lighting device in accordance with an embodiment of the invention.

FIG. 7 illustrates an electrical schematic of lighting device 100 in accordance with an embodiment of the invention. A microprocessor 830 (labeled CPU) may be provided on control PCB 560 and powered by one or more batteries 840 (e.g., which may be provided in cavity 151). Microprocessor 830 may receive input signals (e.g., control signals) from rotary switches 140 and 142 (each of which is connected to an associated group of resistors 820 and 822 as shown in FIG. 7) and dome switch 130. Microprocessor 830 may also receive input signals from one or more switches attached to connector 160. For example, remote switch 106 and/or vertical grip 108 may be implemented as a single stage remote switch attached to connector 160. Other switches such as a dual stage remote switch 860, a multiple device remote switch 870 (e.g., a switch that permits one or more additional secondary devices 880 to be connected therethrough), or other types of switches may be used. Microprocessor 830 may also receive input signals from a Hall effect switch 850 implemented, for example, using Hall effect sensors 571 and 572. In response to the various received signals, microprocessor 830 may selectively operate LEDs 801 and 802 switch on, switch off, operate in a strobe-like manner, and/or provide various brightness levels.

Figure 8A:
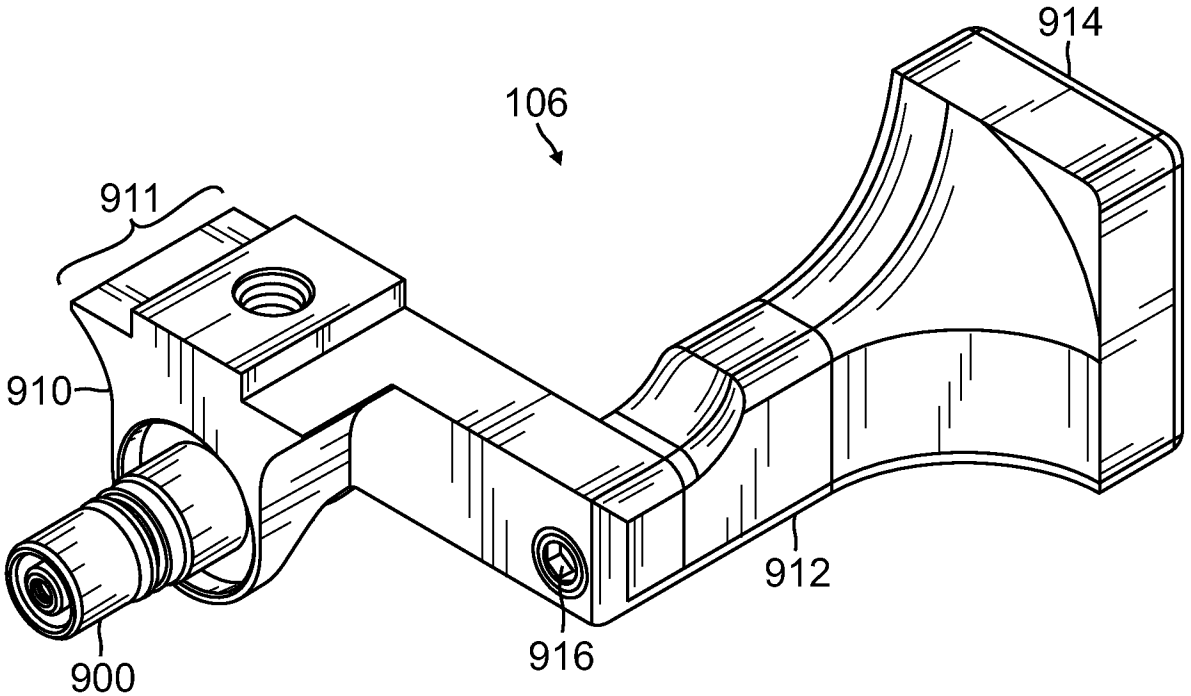
FIGS. 8A-B illustrate a remote switch which may be connected to a lighting device in accordance with several embodiments of the invention.
Figure 8B:
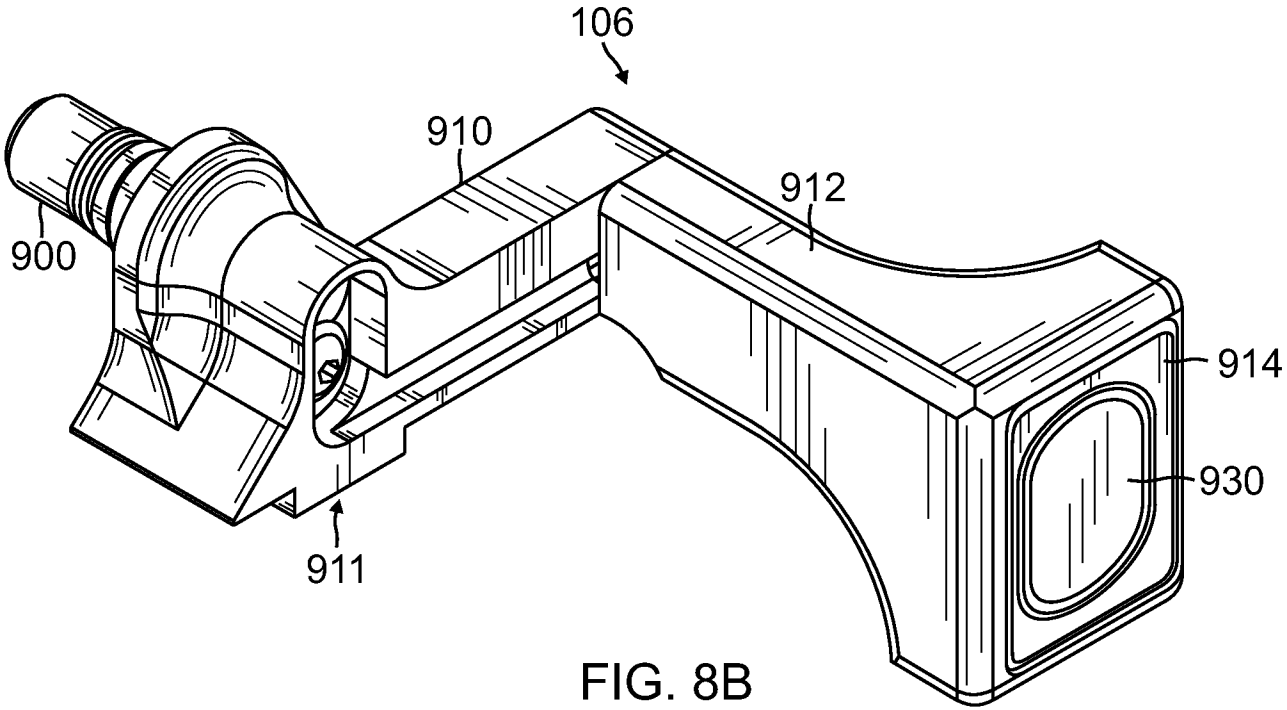
Figure 8C:
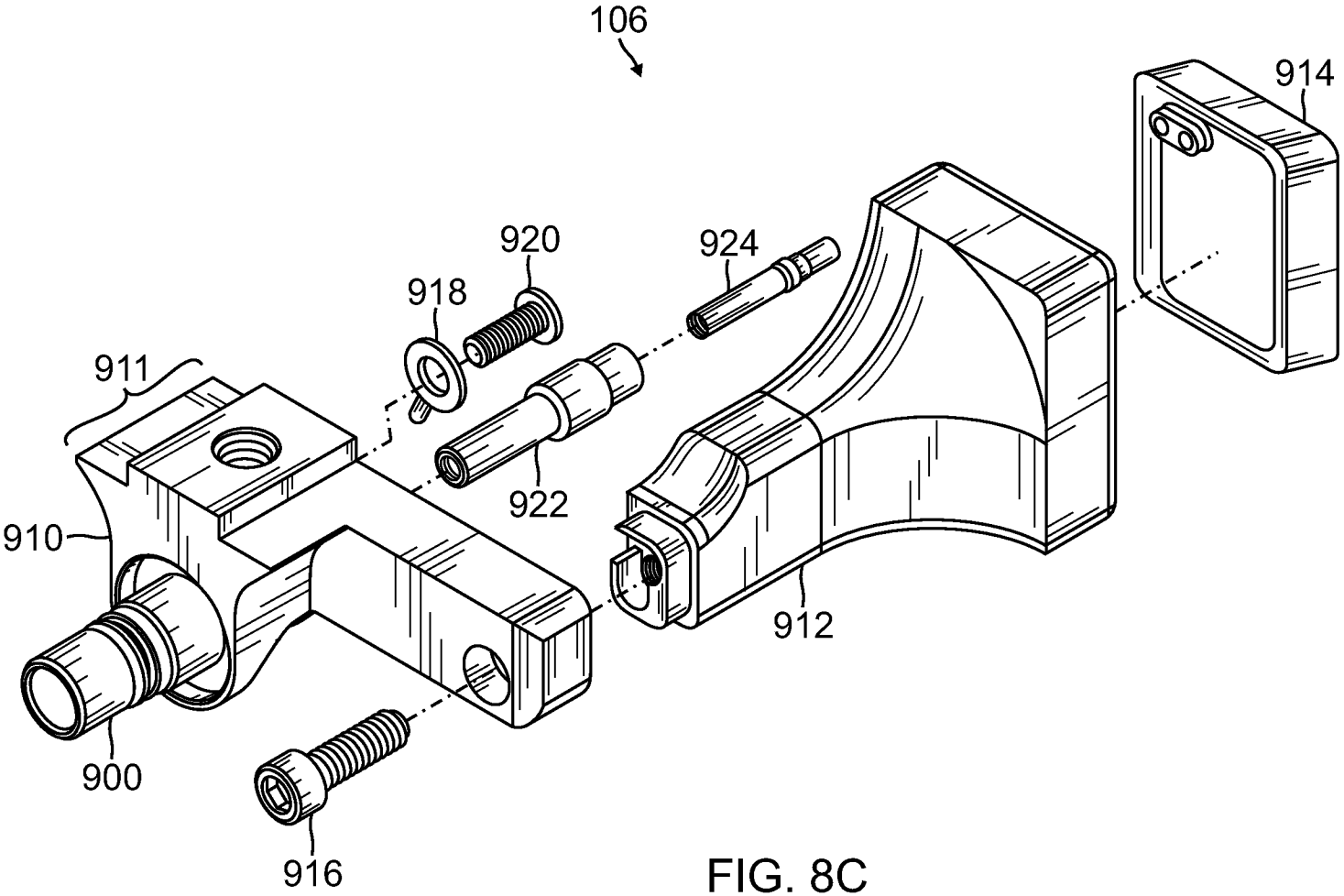
FIG. 8C illustrates an exploded view of a remote switch which may be connected to a lighting device in accordance with an embodiment of the invention.

FIGS. 8A-C illustrate remote switch 106 which may be connected to lighting device 100 in accordance with several embodiments of the invention. In particular, FIGS. 8A-B illustrate remote switch 106 when assembled and FIG. 8C illustrates an exploded view of remote switch 106.

Remote switch 106 includes a connector body 910 having a protrusion 900 for insertion into connector 160 of lighting device 100. A top surface 911 of connector body 910 may engage with rail clamp mount 102 to mount remote switch 106 as shown in FIGS. 1B-C and 2A-B. Remote switch 106 also includes a housing 912 which may be connected to connector body 910 by a screw 916. Remote switch 106 also includes a ring tee terminal 918, screw 920, insulator 922, and socket contact 924.

Remote switch 106 also includes a rear member 914 which may engage with housing 912. As shown in FIG. 8B, rear member 914 includes a surface 930 which may be pushed by the user to operate remote switch 106. Accordingly, the user may provide signals to microprocessor 830 to operate lighting device 100 in a conveniently manner while lighting device 100 is positioned remotely from the user (e.g., near a front end of a weapon or other locations).

Figure 9A:
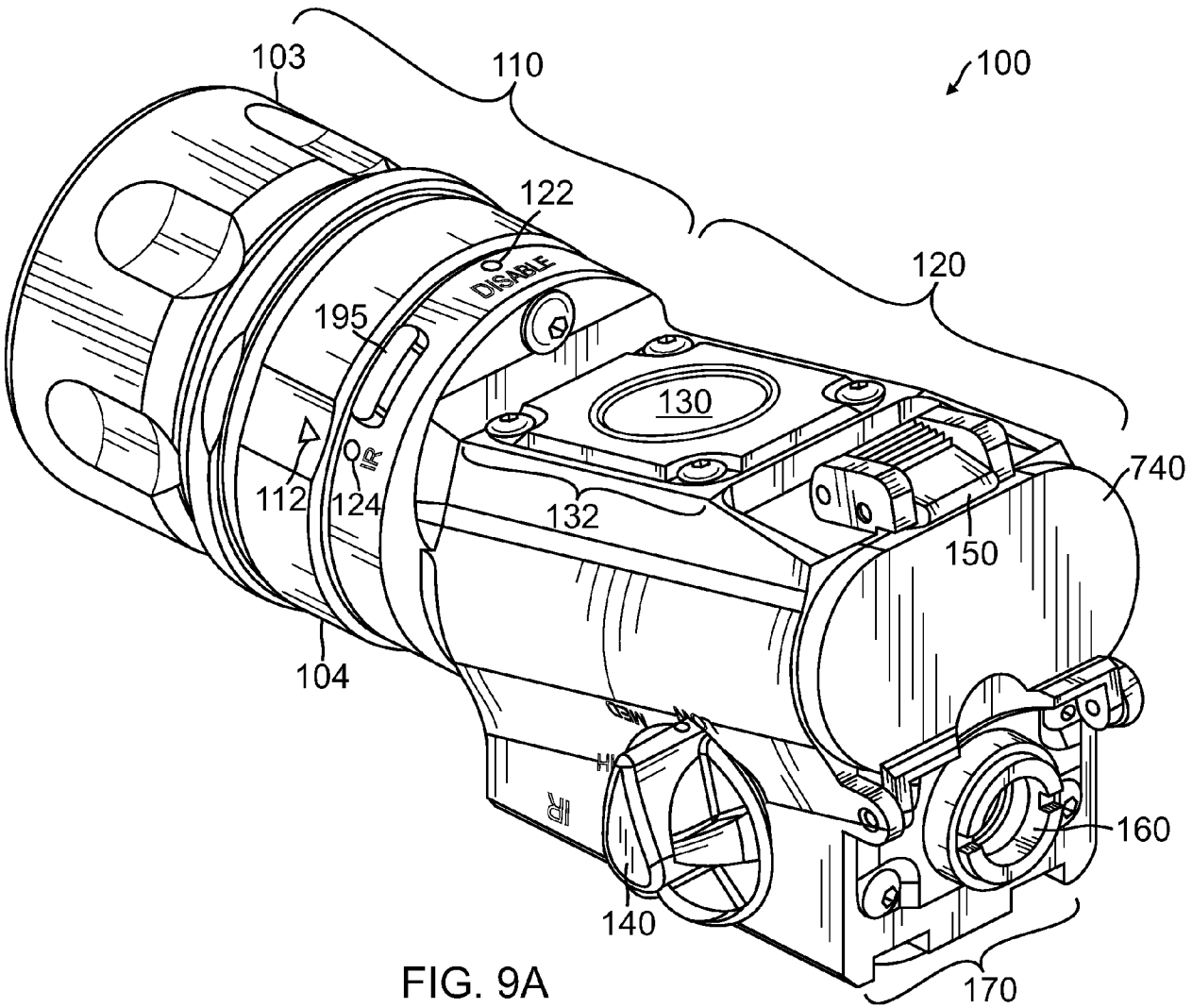
FIG. 9A illustrates a lighting device with an indicator button in an expanded position in accordance with an embodiment of the invention.
Figure 9B:
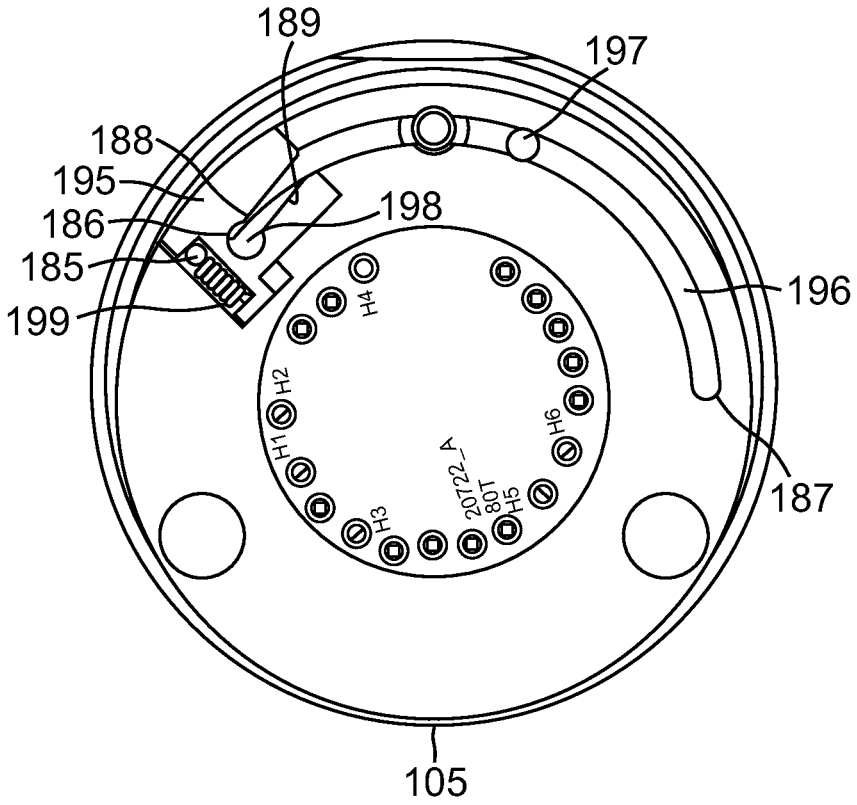
FIG. 9B illustrates a cross-sectional front view of a heat sink of a lighting device with an indicator button in a retracted position in accordance with an embodiment of the invention.
Figure 9C:
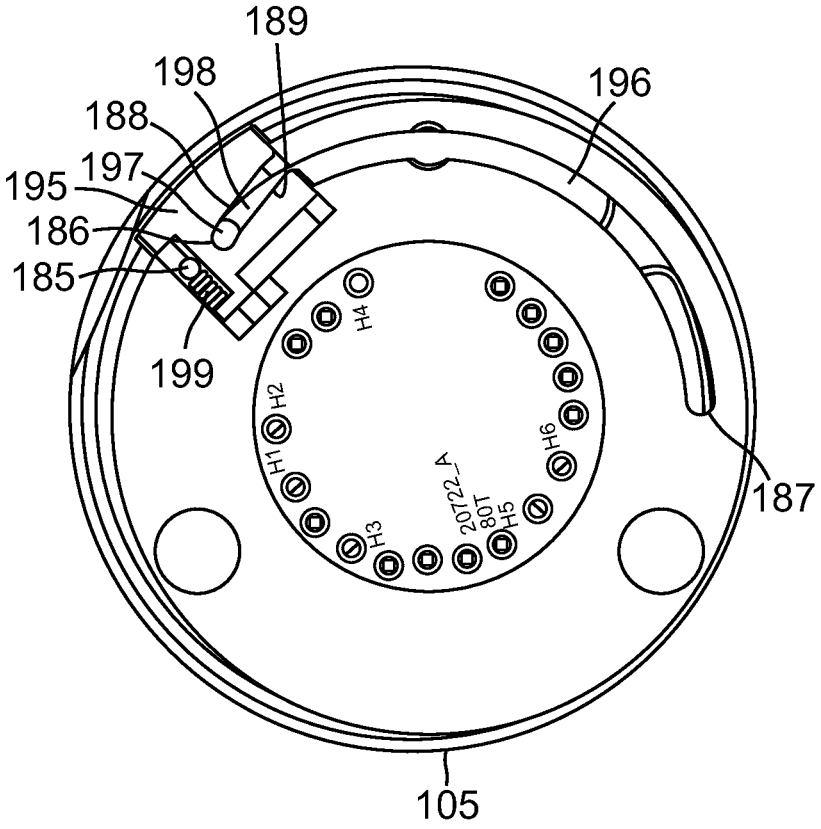
FIG. 9C illustrates a cross-sectional front view of a heat sink of a lighting device with an indicator button in an expanded position in accordance with an embodiment of the invention.

FIG. 9A illustrates a lighting device with an indicator button in an expanded position in accordance with an embodiment of the invention. FIGS. 9B illustrates a cross-sectional top view of a heat sink of a lighting device with an indicator button in a retracted position in accordance with an embodiment of the invention. FIGS. 9C illustrates a cross-sectional top view of a heat sink of a lighting device with an indicator button in an expanded position in accordance with an embodiment of the invention.

Lighting device 100 may include an indicator button 195 which may be selectively expanded out from head 110 or retracted into head 110 in response to the user's rotation of bezel 103 to a particular position. For example, in one embodiment, indicator button 195 may remain in a retracted position (as shown in FIGS. 3A-H and FIG. 9B) except when bezel 103 is rotated such that marker 112 is located next to position 124 at which time indicator button 195 may transition to an expanded position (as shown in FIGS. 9A and 9C). When marker 112 of bezel 103 rotated away from position 124, then indicator button 195 may return to the retracted position.

As shown in FIG. 9B, heat sink 105 includes button 195 which is shown in a retracted position while bezel 103 is set to the disable position (e.g., when marker 112 is proximate position 122). Heat sink 105 also includes pin 197 fixed to bezel 103 which may rotate through a slot 196 as bezel 103 rotates. In particular, pin 197 may rotate to an end 186 of slot 196 (e.g., when marker 112 is proximate position 124) or to another end 187 of slot 196 (e.g., when marker 112 is proximate position 126).

The operation of indicator button 195 may be understood by comparing FIGS. 9B and 9C. In particular, indicator button 195 may be spring loaded by spring 199. As pin 197 rotates toward end 186 of slot 196, indicator button 195 is forced out of heat sink 105 by pin 197. Pin 197 motivates indicator button 195 by way of a groove 198 in indicator button 195. As pin 197 makes contact with groove 198, pin 197 applies outward force on a surface 188 of indicator button 195 and in turn compresses spring 199 and forces indicator button 195 outward. After lock ring 104 is locked in position 124, indicator button 195 remains locked in an expanded position as shown in FIGS. 9A and 9C.

As lock ring 104 is used to rotate pin 197 away from end 186 of slot 196, spring 199 exerts force on a pin 185 of indicator button 195 to motivate indicator button 195 back into a retracted position within heat sink 105. At this time, pin 197 exerts force on a surface 189 of indicator button 195 which assists spring 199 in returning indicator button 195 back to the retracted position.

In view of the present disclosure, it will be appreciated that various structures are provided which may be advantageously used in one or more lighting devices 100. For example, as discussed above, TIR lens 504 may be configured so as to facilitate selection of which light source provides light for lighting device 100. In addition, the inclusion of Hall effect sensors 571 and 572 may be used to facilitate the determination of which light source illuminates during operation of lighting device 100. Thus, TIR lens 504 may be switched among one or more light sources and electric power may be switched among one or more light sources. In this manner, the user may readily select which light source is used by lighting device 100 and consequently what type of light (e.g., white light, infrared light, ultraviolet light, or other light) is provided thereby.

Different types of lenses other than TIR lens 504 may be used. Thus, discussion herein regarding the use of a TIR lens is by way of example only and not by way of limitation. Any desired type of lens/reflector may be used. Any desired combination of types of lenses and/or reflectors may be used. For example, as previously described, one or more lenses (e.g., one or more substantially flat lenses and/or one or more lenses of any other desired shape) and/or one or more reflectors (e.g., one or more substantially parabolic reflectors and/or one or more reflectors of any other desired shape) may be used.

Figure 11A:
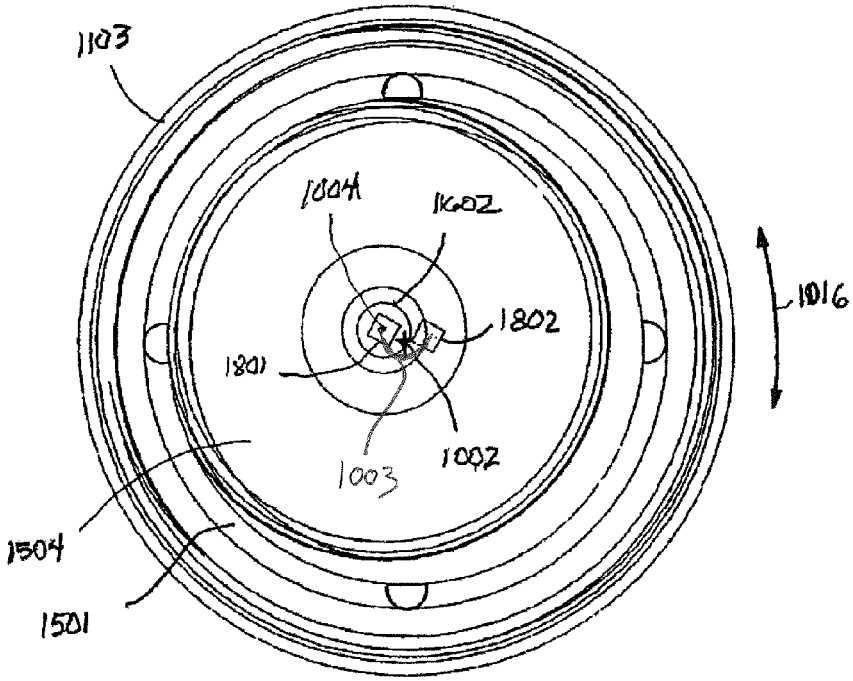
FIGS. 11A and 11B are enlarged front end elevation views of the head of FIG. 10A, respectively showing a bezel and a lens of the device rotated to first and second angular positions relative to a heat sink of the device in accordance with an embodiment of the invention.
Figure 11B:
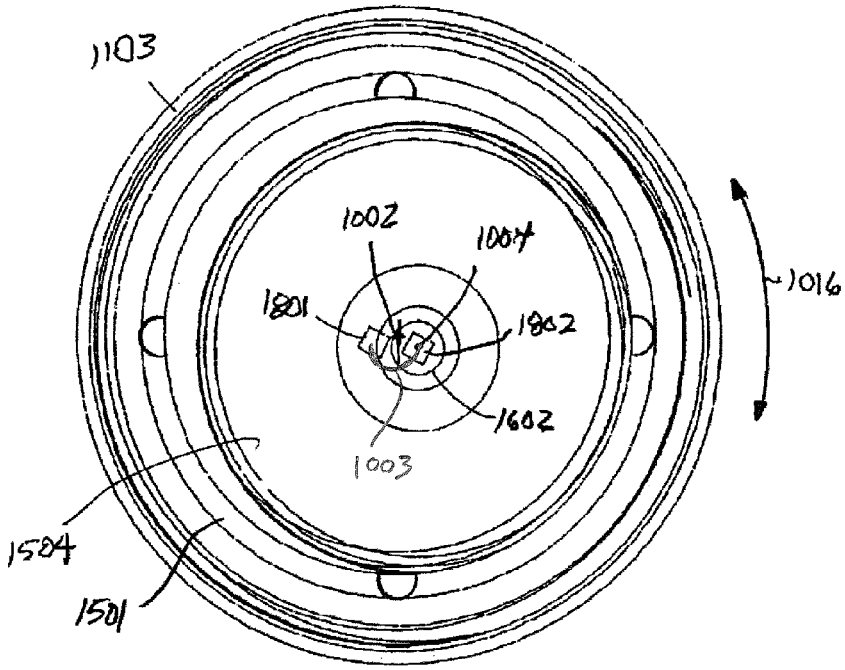
Figure 12:
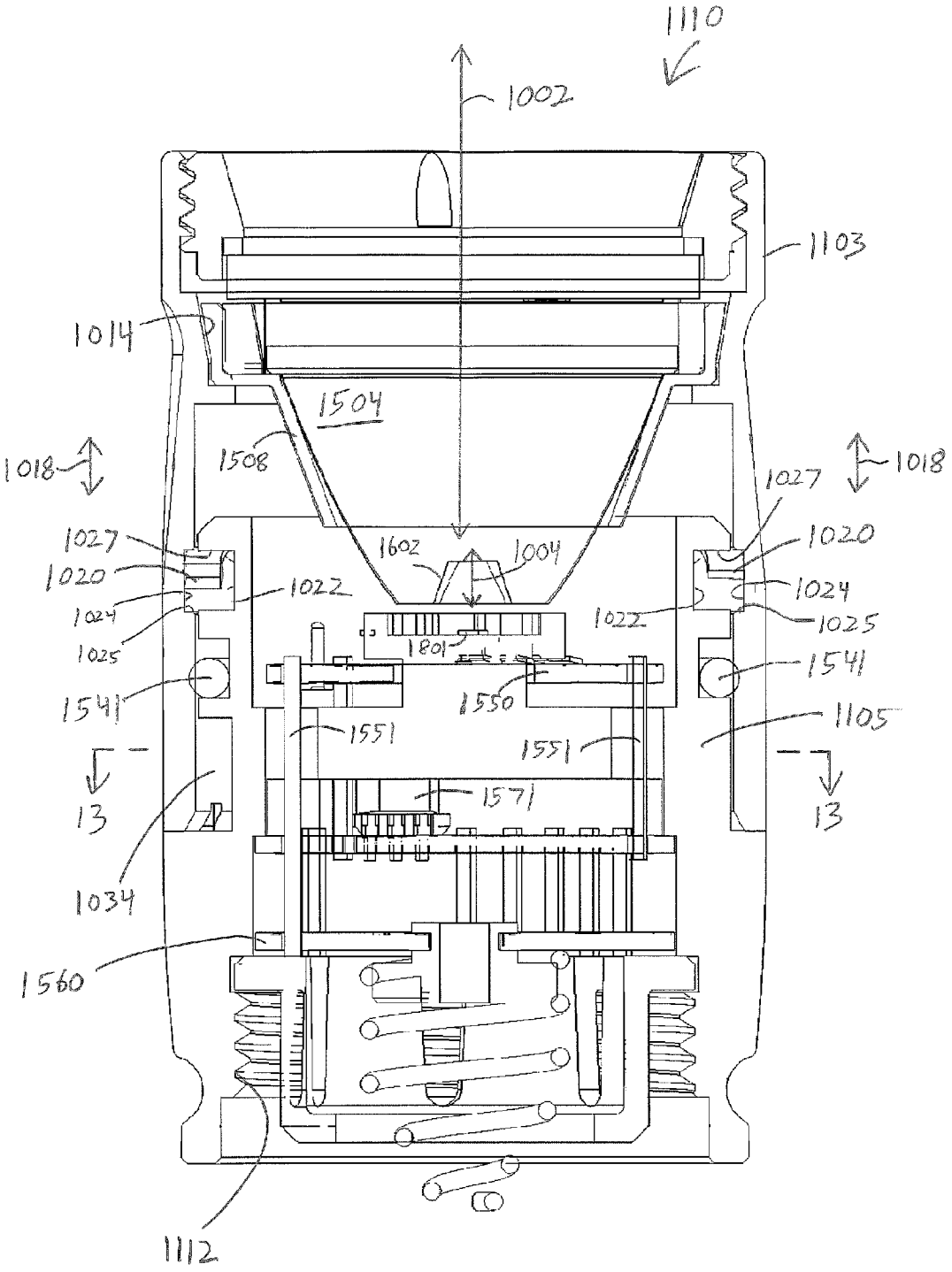
FIG. 12 is a left side cross-sectional view of the head of FIG. 10A as seen along the lines of the section 12-12 taken in FIG. 10A in accordance with an embodiment of the invention.
Figure 13:
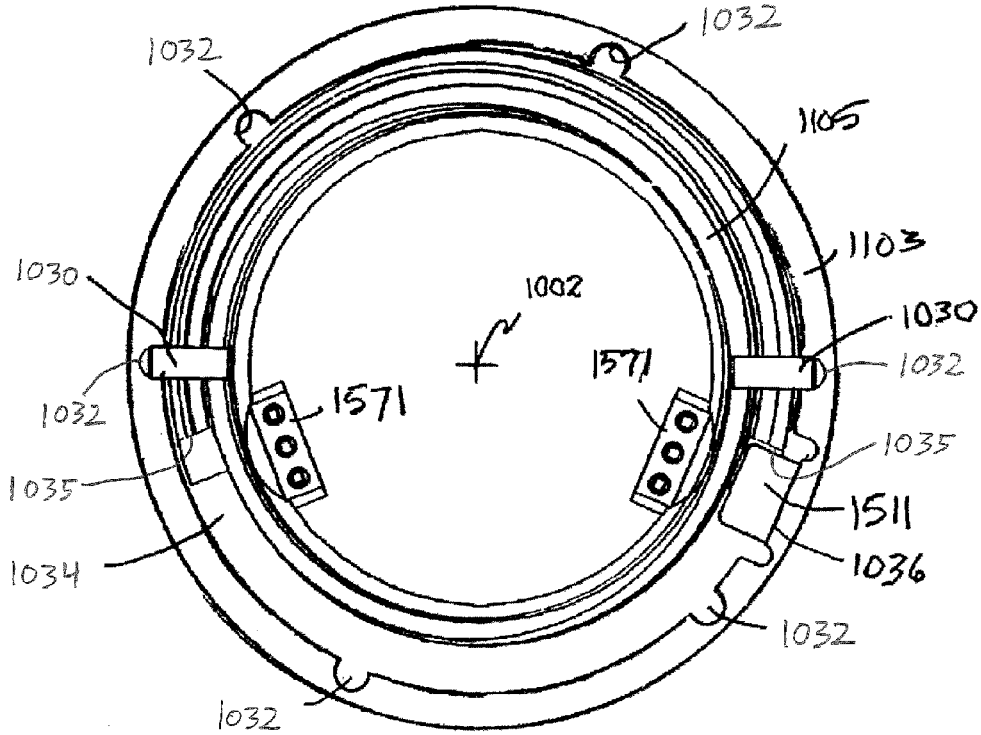
FIG. 13 is a cross-sectional view of the head of FIG. 12 as seen along the lines of the section 13-13 taken therein, and with several components removed for clarity of illustration, in accordance with an embodiment of the invention.

An alternative embodiment of a head 1110 for a lighting device in accordance with the present invention is illustrated in FIGS. 10A-15. In various embodiments, head 1110 can be used with appropriate bodies to provide lighting devices. FIG. 12 is a left side cross-sectional view of the head of FIG. 10A as seen along the lines of the section 12-12 taken in FIG. 10A in accordance with an embodiment of the invention, and FIG. 13 is a cross-sectional view of the head of FIG. 12 as seen along the lines of the section 13-13 taken therein in accordance with an embodiment of the invention.

Figures 10A, 10B:
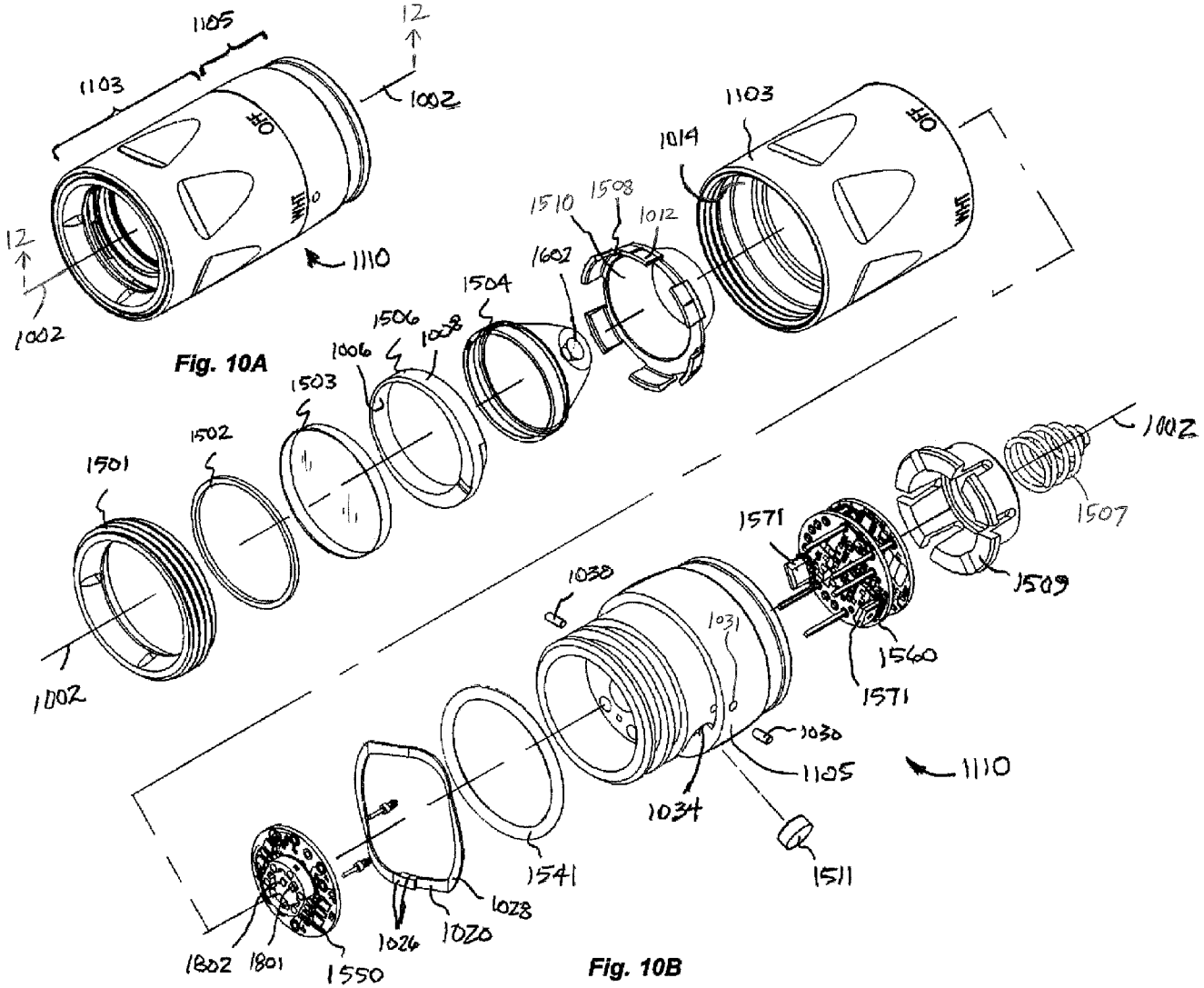
FIG. 10A is an upper, front end perspective view of another head of a lighting device in accordance with an embodiment of the invention.
FIG. 10B is an upper, front end exploded perspective view of the head of FIG. 10A in accordance with an embodiment of the invention.

Referring initially to FIGS. 10A and 10B, it can be seen that the head 1110 comprises a main member 1105 (e.g., a generally tubular structure which may operate, for example, as a heat sink in one embodiment) and a bezel 1103 (e.g., a generally tubular bezel in one embodiment). The bezel 1103 surrounds at least a portion of the main member 1105. The bezel 1103 and the main member 1105 share a common central axis 1002, and the bezel 1103 may be selectively rotated relative to the main member 1105 about the central axis 1002.

A lens 1504 is disposed in the bezel 1103 for conjoint rotation therewith. As discussed, in some embodiments, the lens 1504 can comprise a Total Internal Reflection (TIR) lens having a concentric light inlet 1602 and an optical axis 1004 (see FIGS. 11A and 11B) that is concentric with the light inlet 1602. Alternatively, other lens and/or reflector types can also be used.

Lens 1504 is configured to rotate with the bezel 1103. However, as illustrated in FIGS. 11A-B and 12, and in contrast to the several embodiments discussed herein, lens 1504 is asymmetrically disposed in the bezel 1103. The optical axis 1004 and light inlet 1602 of the lens 1504 are disposed parallel to and offset from the central axis 1002 of the head 1110 such that rotation of the bezel 1103 relative to the main member 1105 causes the light inlet 1602 and optical axis 1004 to rotate through an arc 1003 about the central axis 1002.

As illustrated in FIG. 10B, this offset, or eccentric, mounting of the lens 1504 can be effected, in one embodiment, using a lens mounting collar 1506 having an internal bore 1006 that is disposed eccentrically to the outer circumfery 1008 of the collar 1506. In the example embodiment illustrated, the front end of the lens 1504 is inserted into the eccentric bore 1006 of the collar 1506, and the assembly of the lens 1504 and collar 1506 are then inserted into a support cup 1508 having a correspondingly eccentric, e.g., offset, internal surface 1510 conforming to the rear surface of the lens 1504.

As illustrated in FIG. 10B, in some embodiments, the outer circumfery of the lens support cup 1508 can be provided with a plurality of resilient castellations 1012 that are configured to be received in a corresponding internal circumferential groove 1014 in the bezel 1103 in a snap-in fashion so as to retain the assembly of the eccentric collar 1506, lens 1504 and eccentric support cup 1508 in the bezel 1103. Another support cup 1509 can receive a spring 1507 and also be used to retain and limit compression of the spring 1507, and thereby axial force on a PCB stack 1560. Concentricity and alignment from PCB stack 1560 to a light source PCB 1550 may be provided by close fit to main member 1105 and alignment of associated connecting pins 1551, respectively. As discussed in connection with some of the other embodiments described above, a flat gasket 1502 and a planar lens 1503 can be disposed ahead of the lens 1504, and a threaded lens retainer 1501 can be used to removably secure the entire assembly in the bezel 1103.

As illustrated in FIGS. 10B, 11A and 11B, a number, e.g., two, of light sources 1801 and 1802 can be fixed relative to the main member 1105, e.g., on transversely mounted light source PCB 1550 located behind the light inlet 1602 of the lens 1504, and at respective angular positions around the arc 1003 of rotation of the optical axis 1004, such that rotation of the bezel 1103 about the central axis 1002 to angular positions respectively corresponding to the angular positions of the light sources 1801 and 1802 disposes the light inlet 1602 and optical axis 1004 of the lens 1504 in axial alignment with corresponding ones of the light sources 1801 and 1802. As in some of the embodiments described above, the light sources 1801 and 1802 can comprise LEDs. For example the light source 1801 can comprise an LED emitting, for example, white light (e.g., visible light) when illuminated, and the LED 1802 can comprise an LED emitting, for example, IR or UV light when illuminated.

Thus, as illustrated in FIG. 11A, when the bezel 1103 is rotated about the central axis 1002, e.g., in a direction corresponding to arrows 1016, to an angular position corresponding to that of the light source 1801, the light inlet 1602 and the optical axis 1004 of the lens 1504 will be disposed in axial alignment with the light source 1801, such that, if the light source 1801 is illuminated, a beam of the light produced by the light source 1801 will be emitted from the front end of the lens 1504. On the other hand, when the bezel 1103 is rotated about the central axis 1002 to an angular position corresponding to that of the light source 1802, the light inlet 1602 and the optical axis 1004 of the lens 1504 will then be disposed in axial alignment with the light source 1802, such that, if the light source 1802 is illuminated, a beam of the light produced by the light source 1802 will be emitted from the front end of the lens 1504.

As shown in FIGS. 10B and 12, head 1110 may also include an o-ring 1541 disposed between the main member 1105 and the bezel 1103. O-ring 1541 may contact an interior surface of the bezel 1103 and provide a bearing surface for the bezel 1103 as the bezel 1103 rotates about the central axis 1002.

Head 1110 may include a locking mechanism for releasably locking the bezel 1103 in selected ones of plurality of angular positions relative to the main member 1105, and in particular, angular positions corresponding to those of the light sources and/or to one or more positions corresponding to, for example, an "OFF" state of the head 1110.

As can be seen in FIG. 12, in addition to being rotatably moveable about the main member 1105, the bezel 1103 can also be disposed for axial movement thereon, e.g., in the direction of arrows 1018. The locking mechanism can thus include a resilient mechanism that both retains the bezel 1103 on the main member 1105 axially (e.g., to resist complete removal of the bezel 1103 from the main member 1105), and resiliently biases the bezel 1103 toward (e.g., rearwardly) the main member 1105.

In some embodiments, as illustrated in FIGS. 10B and 12, this resilient retaining and biasing mechanism may be implemented as a wave spring 1020 that is commonly retained in a pair of opposing circumferential channels 1022 and 1024 (e.g., recesses) respectively disposed in an exterior surface of the main member 1105 and an interior surface of the bezel 1103. As illustrated in FIG. 10B, the wave spring 1020, may include separate ends 1026, which permit wave spring 1020 it to be expanded and contracted radially in relation to central axis 1002, and may also include alternating axial corrugations 1028 which permit wave spring 1020 to resiliently expand and contract parallel to central axis 1002 (e.g., in the direction of arrows 1018).

In an example method for assembling the bezel 1103 to the main member 1105, the split wave spring 1020 may be inserted into the "inner" circumferential channel 1022 of the main member 1105 and contracted radially until its outer circumfery is disposed substantially flush with or below the exterior surface of the main member 1105. The bezel 1103 is then slid over the main member 1105 until the "outer" circumferential channel 1024 of the bezel 1103 is disposed in opposition to the circumferential channel 1022 of the main member 1105. The wave spring 1020 is then permitted to expand radially into the outer circumferential channel 1024 of the bezel 1103, such that it then occupies both channels 1022 and 1024, with its alternating corrugations 1028 respectively disposed in abutment with the respective front and rear walls of the two circumferential channels 1022 and 1024. As those of some skill will understand, the foregoing method can be modified by first inserting the wave spring 1020 into the outer circumferential channel 1024 of the bezel 1103 and then expanding it radially therein.

In either case, after the bezel 1103 has been assembled with the main member 1105 using the wave spring 1020 as illustrated in FIG. 12, the split wave spring 1020 operates both to retain the bezel 1103 on the main member 1105 axially and to resiliently bias the bezel 1103 downwardly (e.g., rearwardly) toward the main member 1105 when compressed. That is, a user's grasping of the bezel 1103 and urging it axially upwardly (e.g., forwardly) away from the main member 1105 acts to expand the wave spring 1020 in the axial direction such that, if the bezel 1103 is then released, the compressive force in the spring 1020 will then urge the bezel 1103 back toward the main member 1105. This rearward axial biasing force can be used advantageously in the releasable locking mechanism as further described herein.

In addition, as bezel 1103 is urged axially upwardly away from the main member 1105, wave spring 1020 may continue to protrude into circumferential channel 1024 of bezel 1103 and also into circumferential channel 1022 of main member 1105. If bezel 1103 is further urged, wave spring 1020 will become abutted against one or more bottom walls 1025 of circumferential channel 1024 and one or more top walls 1027 of circumferential channel 1022. As a result, this will cause wave spring 1020 to impede further upward axial movement of bezel 1103 relative to main member 1105.

As illustrated in FIG. 13, the locking mechanism may include one or more pins 1030 protruding radially from the main member 1105 (e.g., inserted into corresponding recesses 1031 in main member 1105) and acting in cooperation with one or more corresponding radial slots 1032 extending into the rear end of the bezel 1103. When the bezel 1103 is positioned rearwardly against the main member 1105 (e.g., in the position illustrated in FIG. 12), the pins 1030 and the slots 1032 lie in a common transverse plane, as illustrated in FIG. 13, and can be arranged therein at respective angular positions about the central axis 1002 such that, at selected angular positions of the bezel 1103 relative to the main member 1105, the one or more pins 1030 are releasably engaged in corresponding ones of the slots 1032 (e.g., the slots 1032 may receive the pins 1030 as the bezel 1103 moves rearwardly toward the main member 1105) so as to prevent rotation of the bezel 1103 relative to the main member 1105.

In the particular example embodiment illustrated in FIG. 13, one pair of radially protruding pins 1030 is disposed on the main member 1105, spaced about 180 degrees apart, and three pairs of corresponding slots 1032 in the bezel 1103, the slots 1032 of each pair being spaced about 180 degrees apart, the pairs being spaced about 60 degrees apart. However, it should be understood that other numbers and arrangements of pins 1030 and slots 1032 may be used in other embodiments as desired.

An example method for releasably locking the bezel 1103 at a selected angular position relative to the main member 1105 using the example locking mechanism described above may include a user grasping the bezel 1103, and then urging it axially forward relative to (e.g., away from) the main member 1105 and against the axial bias of the wave spring 1020. The urging causes the pins 1030 to disengage from the slots 1032. The user may then rotate the bezel 1103 relative to the heat sink 1103 until at least one of the slots 1032 is axially aligned with at least one of the pins 1030, then release the bezel 1103 such that the bias of the wave spring 1020 urges the bezel 1103 toward the main member 1105, and hence, the at least one slot 1032 into axial engagement with the at least one pin 1030. Such operations may be repeated as desired to move the bezel 1103 between various selected angular positions.

During its rotation, the bezel 1103 rotates concentrically with the central axis 1002 while the light inlet 1602 and optical axis 1004 of the lens 1504 to rotate through an arc 1003 about the central axis 1002. Also, after at least a partial rotation has been performed, slots 1032 may no longer be aligned with pins 1030. As a result, unslotted portions of the bottom of the bezel 1103 may rest on pins 1030 while being biased downward toward the pins 1030 by wave spring 1020 as the rotation continues, thus reducing the need for a user to continue applying axial urging force until the next one of the slots 1032 is aligned with at least one of the pins 1030.

Head 1110 may include a switching mechanism used to control the operation of respective ones of light sources 1081 and 1082 when the light inlet 1602 and optical axis 1004 of the lens 1504 are disposed in axial alignment therewith.

Referring now to FIGS. 12 and 13, such a switching mechanism may include a circumferential groove 1034 disposed in an exterior surface of the main member 1105, and a magnet 1511, e.g., a permanent magnet in one embodiment, fixed relative to (e.g., coupled to and/or otherwise positioned) an interior surface 1036 of the bezel 1103 and arranged to move (e.g., slide) circumferentially within the circumferential groove 1034 of the main member 1105 as the bezel 1103 is rotated relative thereto. Circumferential groove 1034 includes ends 1035 which may receive magnet 1511 and define a rotation range of the bezel 1103 relative to the main member 1105. In this regard, as the magnet 1511 slides to each of ends 1035, the bezel 1103 may be prevented from further rotation due to the fixed relationship between the magnet 1511 and the bezel 1103 (e.g., contact between the magnet 1511 and the ends 1035 may physically prevent further rotation of the bezel 1103). In some embodiments, the rotation range of the bezel 1103 may be less than a full circumference of the main member 1105 (e.g., approximately 135 degrees in one embodiment).

As discussed herein with regard to FIGS. 11A and 11B, a plurality of light sources, e.g., light sources 1801 and 1082, can be coupled to the main member 1105, e.g., via a light source PCB 1550, and disposed at first and second angular positions about the central axis 1002. As illustrated in FIG. 13, a pair of sensors 1571 (e.g., Hall effect sensors as described herein), can be fixed relative to (e.g., coupled to and/or otherwise positioned) the main member 1105 and respectively disposed at third and fourth angular positions about the central axis 1002. Each of the sensors 1571 can be made operable to detect the proximity of the magnet 1511 and to provide one or more control signals to selectively switch respective ones of the light sources 1801 and 1802 based on the detected proximity. In one embodiment, sensors 1571 may detect the magnet 1511 within approximately 30 degrees of angular rotation. In one embodiment, sensors 1571 may detect magnet 1511 regardless of the polarity orientation of magnet 1511.

If the sensors 1571 are positioned at angular positions respectively corresponding to those of the light sources 1801 and 1802, rotation of the bezel 1103 about the central axis 1002 and to an angular position corresponding to that of one of the light sources 1801 or 1802 can operate both to dispose the light inlet 1602 and optical axis 1004 of the lens 1504 in axial alignment with the corresponding light source 1801 or 1802, and to dispose the magnet 1511 at the predetermined distance from the corresponding sensor 1571, thereby causing the corresponding light source 1801 or 1802 to illuminate through operation of appropriate control signals.

Thus, as illustrated in the particular example embodiment of FIG. 13, the angular position of the bezel 1103 relative to the main member 1105 can be such that the magnet 1511 is disposed immediately adjacent to a first one of the two sensors 1571, thereby disposing the light inlet 1602 and optical axis 1004 of the lens 1504 in axial alignment with a corresponding light source 1802, as illustrated in FIG. 11B, and causing the corresponding light source 1802 to be illuminated.

Then, a rotation of the bezel 1103 relative to the main member 1105 to a second angular position corresponding to those of the other light source 1801 and sensor 1571 causes the magnet 1511 to be disposed immediately adjacent to the other sensor 1571, thereby turning off the first light source 1802, disposing the light inlet 1602 and optical axis 1004 of the lens 1504 in axial alignment with the other light source 1801, as illustrated in FIG. 11A, and causing the other light source 1801 to be illuminated.

As discussed above, a relative angular position of the bezel 1103 between or on either side of the two light sources 1801 and 1802 and their corresponding sensors 1571 can correspond to an OFF condition of the head 1110, and the number of light sources 1801 and 1802 and corresponding sensors that can be used in the device can differ from the two illustrated in the example embodiment of the figures.

Head 1110 and various other heads in accordance with the present disclosure may be used to implement any desired type of lighting device. In various embodiments, head 1110 may be attached to a body (e.g., any of the various bodies described herein or others as appropriate) to provide a lighting device suitable for mounted use, handheld use, portable applications, fixed applications, and/or others as appropriate.

Figure 14:
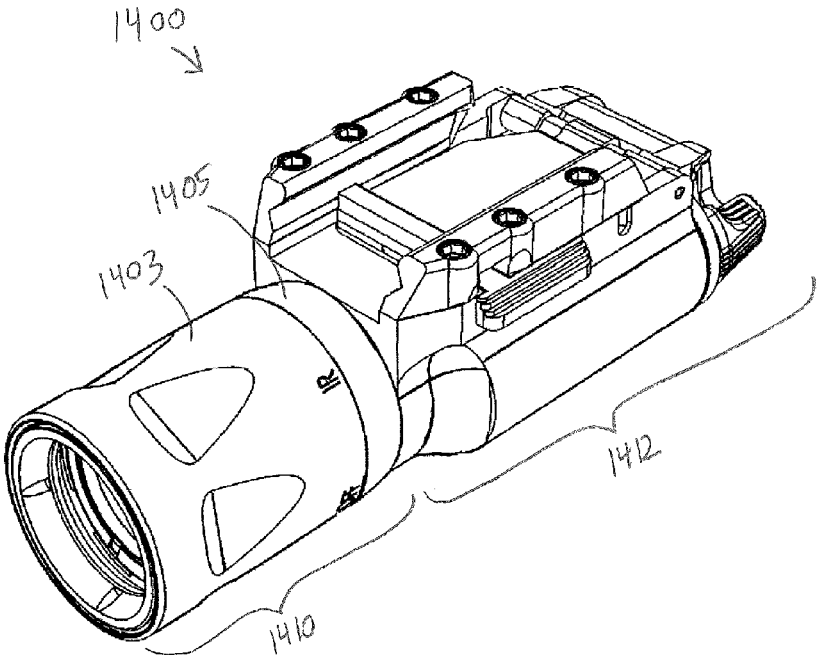
FIG. 14 is an upper front perspective view of a lighting device including a head providing similar features to that of FIG. 10A and further including a body useful for coupling the lighting device to a pistol in accordance with an embodiment of the invention.

For example, FIG. 14 is an upper front perspective view of a lighting device 1400 including a head 1410 providing similar features to that of head 1110 of FIG. 10A and further including a body 1412 useful for coupling the lighting device 1400 to a pistol in accordance with an embodiment of the invention. In one embodiment, head 1410 may include a bezel 1403 that is further elongated than bezel 1103, and a main member 1405 (e.g., a heat sink in one embodiment) that is shorter than main member 1105 and includes external threads to screw into complementary internal threads of body 1412 (e.g., main member 1405 may be threaded into body 1412).

Figure 15:
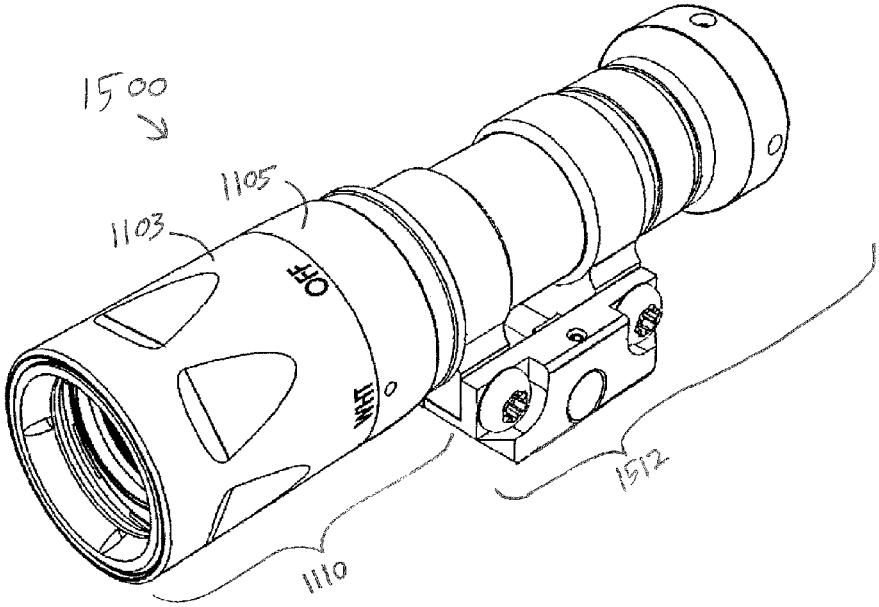
FIG. 15 is an upper front perspective view of a lighting device including the head of FIG. 10A and further including a body useful for coupling the lighting device to a rifle in accordance with an embodiment of the invention.

FIG. 15 is an upper front perspective view of a lighting device 1500 including the head 1110 and further including a body 1512 useful for coupling the lighting device 1500 to a rifle in accordance with an embodiment of the invention. In one embodiment, main member 1105 includes internal threads 1112 (see FIG. 12) that may be used to screw onto complementary external threads of body 1512 (e.g., main member 1105 may be threaded onto body 1512).

Such lighting devices 1400, 1500, and others described herein may be mounted and/or otherwise attached to firearms or other attachment locations using, for example, rails, clamps, intermediate attachment members, and/or other mechanisms provided separate from and/or integrated with the bodies of the lighting devices.

Although particular switches have been described, one or more other types of controls and/or switches may be used where appropriate.

The discussion of particular light sources herein is by way of example only and not by way of limitation. Any desired number and wavelengths of light sources may be used (e.g., white light sources, visible light sources, infrared light sources, ultraviolet light sources, or other light sources). Such light sources may be grouped in any desired manner. For example, one group may include only white light sources that cooperate to provide white light when white light is selected and another group may include only infrared light sources that cooperate to provide infrared light when infrared light is selected.

Embodiments are not limited to the use of LEDs as light sources. Light sources other than LEDs may be used. For example, light sources such as LEDs, arc lamps, tungsten lamps, or any other type of light sources may be used. Thus, discussion herein regarding the use of LEDs is by way of example only and not by way of limitation. Embodiments may include any desired light sources or combination of light sources.

Embodiments are not limited to use in weapon mounted lighting devices. Discussion herein of weapon mounting is by way of example only and not by way of limitation. Embodiments may be configured for use with flashlights, weapon (such as rifles and pistols) mounted lights, helmet mounted lights, headlamps, and vehicle lights. Indeed, embodiments may be used with any desired device. Thus, embodiments may provide light source switching for a variety of different applications. For example, the lighting device described herein may be configured to mount to a flashlight, a rifle or pistol, a helmet, a vehicle, or any other item. The lighting device may mount to such items via threads, mounts, adapters, or other appropriate ways.

The disclosure is not intended to limit the present invention to the precise forms or particular fields of use disclosed. It is contemplated that various alternate embodiments and/or modifications to the present invention, whether explicitly described or implied herein, are possible in light of the disclosure. For example, it is contemplated that the various embodiments set forth herein may be combined together and/or separated into additional embodiments where appropriate.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:

a main member comprising a central axis;

a bezel surrounding at least a portion of the main member and adapted to be concentrically rotated about the central axis;

a lens asymmetrically disposed in the bezel and adapted to rotate with the bezel, the lens comprising a light inlet offset from the central axis; and a plurality of light sources fixed relative to the main member, wherein rotation of the bezel relative to the main member causes the light inlet to rotate through an arc about the central axis to selectively align different ones of the light sources with the light inlet.

2. The lighting device of claim 1, further comprising:

at least one pin protruding from the main member;

a plurality of slots in the bezel adapted to selectively receive the pin; and a resilient mechanism adapted to axially bias the bezel toward the main member to engage the pin with corresponding ones of the slots to prevent rotation of the bezel relative to the main member when the bezel is situated at selected angular positions.

3. The lighting device of claim 2, wherein the resilient mechanism is a wave spring.

4. The lighting device of claim 3, wherein the wave spring protrudes into a first recess in an exterior surface of the main member and a second recess in an interior surface of the bezel to resist complete removal of the bezel from main member.

5. The lighting device of claim 1, further comprising an o-ring disposed between the main member and the bezel, wherein an interior surface of the bezel is adapted to contact the o-ring as the bezel rotates about the central axis.

6. The lighting device of claim 1, further comprising:

a circumferential groove disposed in an exterior surface of the main member;

a magnet fixed relative to an interior surface of the bezel and adapted to slide within the circumferential groove as the bezel is rotated relative to the main member; and at least one sensor fixed relative to the main member and adapted to detect a proximity of the magnet to the sensor and provide one or more control signals to selectively switch at least one of the light sources on or off based on the detected proximity.

7. The lighting device of claim 6, wherein the circumferential groove comprises first and second ends adapted to receive the magnet and define a rotation range of the bezel relative to the main member.

8. The lighting device of claim 1, wherein the main member is a heat sink.

9. The lighting device of claim 1, wherein a first one of the light sources is a visible light emitting diode (LED) and a second one of the light sources is an infrared LED.

10. The lighting device of claim 1, further comprising:

a body;

a head attached to the body, wherein the head comprises the main member, the bezel, the lens, and the light sources; and wherein the body is adapted to be attached to a firearm.

11. A firearm comprising:

a mounting mechanism; and the lighting device of claim 10 attached by the mounting mechanism.

12. A method of operating a lighting device, the lighting device comprising a main member comprising a central axis, a bezel surrounding at least a portion of the main member, a lens asymmetrically disposed in the bezel and adapted to rotate with the bezel and comprising a light inlet offset from the central axis, and a plurality of light sources fixed relative to the main member, the method comprising:

concentrically rotating the bezel about the central axis relative to the main member, wherein the rotating causes the light inlet to rotate through an arc about the central axis to selectively align different ones of the light sources with the light inlet.

13. The method of claim 12, wherein the lighting device further comprises at least one pin protruding from the main member, a plurality of slots in the bezel adapted to selectively receive the pin, and a resilient mechanism adapted to axially bias the bezel toward the main member to engage the pin with corresponding ones of the slots to prevent rotation of the bezel relative to the main member when the bezel is situated at selected angular positions, the method further comprising:

prior to the rotating, urging the bezel axially away from the main member and against the axial bias of the resilient mechanism, wherein the urging causes the pin to disengage with a first one of the slots; and after the rotating, releasing the bezel, wherein the axial bias of the resilient mechanism causes the pin to engage with a second one or the slots.

14. The method of claim 13, wherein the resilient mechanism is a wave spring.

15. The method of claim 14, wherein the wave spring protrudes into a first recess in an exterior surface of the main member and a second recess in an interior surface of the bezel to resist complete removal of the bezel from main member.

16. The method of claim 12, wherein an interior surface of the bezel contacts an o-ring disposed between the main member and the bezel during the rotating.

17. The method of claim 12, wherein the lighting device further comprises a circumferential groove disposed in an exterior surface of the main member, a magnet fixed relative to an interior surface of the bezel, and at least one sensor fixed relative to the main member, the method further comprising:

sliding the magnet within the circumferential groove during the rotating;

detecting a proximity of the magnet to the sensor; and providing one or more control signals to selectively switch at least one of the light sources on or off based on the detected proximity.

18. The method of claim 17, wherein the circumferential groove comprises first and second ends adapted to receive the magnet and define a rotation range of the bezel relative to the main member.

19. The method of claim 12, wherein the main member is a heat sink.

20. The method of claim 12, wherein a first one of the light sources is a visible light emitting diode (LED) and a second one of the light sources is an infrared LED.

21. The method of claim 12, further comprising:

attaching the lighting device to a firearm.

* * * * *